US005698365A

United States Patent [19]

Taguchi et al.

[11] Patent Number: 5,698,365

[45] Date of Patent: Dec. 16, 1997

[54] HEAT DEVELOPMENT COLOR PHOTOGRAPHIC MATERIAL

[75] Inventors: Toshiki Taguchi; Koki Nakamura, both of Kanagawa, Japan

[73] Assignee: Fuji Photo Film Co., Ltd., Kanagawa, Japan

[21] Appl. No.: 819,128

[22] Filed: Mar. 17, 1997

Related U.S. Application Data

[63] Continuation of Ser. No. 559,084, Nov. 17, 1995, abandoned.

[30] Foreign Application Priority Data

Nov. 17, 1994 [JP] Japan ..... HEI 6-307049

[51] Int. Cl.[6] ..... G03C 8/40; G03C 8/36; G03C 1/498

[52] U.S. Cl. ..... 430/203; 430/243; 430/619

[58] Field of Search ..... 430/203, 619, 430/243, 249, 505

[56] References Cited

U.S. PATENT DOCUMENTS 4,021,240 5/1977 Cerquone et al. .

FOREIGN PATENT DOCUMENTS 60-128438 9/1985 Japan .
2156091 10/1985 United Kingdom .

*Primary Examiner*—Thorl Chea

*Attorney, Agent, or Firm*—Sughrue, Mion, Zinn, Macpeak & Seas, PLLC

[57] ABSTRACT

A heat development color photographic material excellent in discrimination and raw preservability of images, which comprises a support, and at least a light-sensitive silver halide, a binder, a coupler and a reducing agent formed thereon, in which a 2-acylamino-4-sulfonamidophenol derivative represented by the following general formula (I) is contained as said reducing agent:

(I)

wherein $R_1$ represents a substituent group (for example, alkyl or aryl); $R_2$ to $R_4$ each represents hydrogen or a substituent group (for example, halogen, alkyl or aryl); and $R_5$ represents a substituent group (for example, alkyl or aryl).

6 Claims, No Drawings

HEAT DEVELOPMENT COLOR PHOTOGRAPHIC MATERIAL

This is a Continuation of application Ser. No. 08/559,084 filed Nov. 17, 1995, now abandoned.

FIELD OF THE INVENTION

The present invention relates to a heat development color photographic material, and more particularly to a heat development color photographic material high in activity and excellent in raw preservability.

BACKGROUND OF THE INVENTION

Photographic methods using silver halides are excellent in photographic characteristics such as sensitivity and gradation control, as compared with other photographic methods such as electrophotographic methods and diazo photographic methods, and therefore have previously been widely used. In particular, the photographic methods using silver halides provide as high image quality as color hard copies, so that intensive investigation has recently been conducted on them.

In recent years, systems which can obtain images easily and rapidly have been developed by shifting image forming processing of photographic materials using silver halides from conventional wet processing to instant photographic systems containing developing solutions and further to dry heat development processing by heating. Heat development photographic materials are described in *Shashin Kohgaku no Kiso* (*Higinen Shashin*) [*The Fundamentals of Photographic Engineering* (*Nonsilver salt Photograph*)], infra page 242, Corona Publishing Co. Ltd. However, black-and-white image forming methods represented by dry silver are merely described therein. Recently, commercial products such as Color Dry Silver supplied from Minnesota Mining and Manufacturing Co. and PICTROGRAPHY® and PICTROSTAT® supplied by Fuji Photo Film Co., Ltd. have been put on the market. In the above-mentioned easy rapid processing methods, the former uses a leuco dye and the latter uses a redox color material to which a preformed dye is attached to form color images. Methods utilizing coupling reaction of couplers and developing agent oxidants are most general as the color image forming methods of photographic materials. As to heat development color photographic materials employing these methods, many patents have been applied for, for example, U.S. Pat. Nos. 3,761,270 and 4,021,240 and JP-A-59-231539 (the term "JP-A" as used herein means an "unexamined published Japanese patent application").

However, when color images are formed by heat development employing coupling reaction, no developing solution is used as a general rule. It is therefore indispensable to include a developing agent in some form. In this case, the most important problem is to develop a method for stably containing the developing agent and a method for preventing stains produced from the residual developing agent after processing. As ideas for solving this problem, various methods are described, for example, in JP-A-63-52137, JP-A-1-161239, JP-A-3-15052, JP-A-60-128438 and U.S. Pat. No. 4,021,240. Of these techniques, particularly, sulfonamidophenols described in U.S. Pat. No. 4,021,240 and JP-A-60-128438 are known to be sufficiently stable to include as developing agents and to scarcely produce stains after processing.

SUMMARY OF THE INVENTION

The present inventors have developed coupling type heat development color photographic materials containing the above-mentioned sulfonamidophenols as the developing agents. Results of our studies revealed that when the sulfonamidophenol developing agents are used to form images, use of 2,6-dihalogeno-4-sulfonamidophenol did not provide coupling images having sufficient density. As a method for solving this problem, the technique of forming intramolecular hydrogen bonds to reduce the pKa, thereby increasing development activity, was considered. However, it turned out that a developing agent which is substituted by a sulfonamido group at the 2-position as described in JP-A-60-198540 did not give sufficient activity.

An object of the present invention is to provide a heat development color photographic material high in activity and excellent in raw preservability.

According to the present invention, there is provided a heat development color photographic material comprising a support, and at least a light-sensitive silver halide, a binder, a reducing agent and a coupler formed thereon, in which at least one compound represented by the following general formula (I) is contained as said reducing agent:

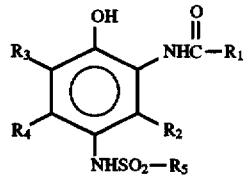

(I)

wherein $R_1$ represents a substituted or unsubstituted alkyl, alkenyl, alkynyl, aryl, alkylcarbonyl, arylcarbonyl, alkoxyl, aryloxy, alkoxycarbonyl, aryloxycarbonyl, alkylamino, arylamino or heterocyclic group; $R_2$ to $R_4$ each independently represents a hydrogen atom, a halogen atom, an alkyl, aryl, alkylcarbonamido, arylcarbonamido, alkylsulfonamido, arylsulfonamido, alkoxyl, aryloxy, alkylthio, arylthio, alkylcarbamoyl, arylcarbamoyl, carbamoyl, alkylsulfamoyl, arylsulfamoyl, sulfamoyl, cyano, alklsulfonyl, arylsulfonyl, alkoxycarbonyl, aryloxycarbonyl, alkylcarbonyl, arylcarbonyl or acyloxy group; and $R_5$ represents a substituted or unsubstituted alkyl, aryl or heterocyclic group.

DETAILED DESCRIPTION OF THE INVENTION

The present invention will be described in detail below.

The compounds represented by general formula (I) are described in detail.

These compounds are compounds known generically as 2-acylamino-4-sulfonamidophenol derivatives, and can be indicated by general formula (I):

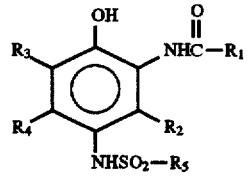

(I)

wherein $R_1$ represents a substituted or unsubstituted alkyl (for example, methyl, ethyl, isopropyl, n-butyl or t-butyl), alkenyl (for example, ethenyl or propenyl), alkynyl (for example, ethynyl or propynyl), aryl (for example, phenyl, tolyl or xylyl), alkylcarbonyl (for example, acetyl or butyroyl), arylcarbonyl (for example, benzoyl or 4-methylbenzoyl), alkoxyl (for example, methoxy or ethoxy), aryloxy (for example, phenoxy), alkoxycarbonyl (for example, methoxycarbonyl, ethoxycarbonyl or butoxycarbonyl), aryloxycarbonyl (for example, phenoxycarbonyl), alkylamino for example, methylamino, dimethylamino, diethylamino, butylamino, piperidyl or morpholyl), arylamino (for example, anilino, N-methylanilino or N-ethylanilino) or heterocyclic group (for example, pyridyl, quinolyl or furyl); $R_2$ to $R_4$ each independently represents a hydrogen atom, a halogen atom (for example, chlorine or bromine), an alkyl (for example, methyl, ethyl, isopropyl, n-butyl or t-butyl), aryl (for example, phenyl, tolyl or xylyl), alkylcarbonamido (for example, acetylamino, propionylamino or butyroylamino), arylcarbonamido (benzoylamino), alkylsulfonamido (for example, methanesulfonylamino or ethanesulfonylamino), arylsulfonamido (for example, benzenesulfonylamino or toluenesulfonylamino), alkoxyl (for example, methoxy, ethoxy or butoxy), aryloxy (for example, phenoxy), alkylthio (for example, methylthio, ethylthio or butylthio), arylthio (for example, phenylthio or tolylthio), alkylcarbamoyl (for example, methylcarbamoyl, dimethylcarbamoyl, ethylcarbamoyl, diethylcarbamoyl, dibutylcarbamoyl, piperidylcarbamoyl or morpholylcarbamoyl), arylcarbamoyl (for example, phenyl-carbamoyl, methylphenylcarbamoyl, ethylphenylcarbamoyl or benzylphenylcarbamoyl), carbamoyl, alkylsulfamoyl (for example, methylsulfamoyl, dimethylsulfamoyl, ethylsulfamoyl, diethylsulfamoyl, dibutylsulfamoyl, piperidylsulfamoyl or morpholylsulfamoyl), arylsulfamoyl (for example, phenylsulfamoyl, methylphenyl-sulfamoyl, ethylphenylsulfamoyl or benzylphenylsulfamoyl), sulfamoyl, cyano, alkylsulfonyl (for example, methanesulfonyl or ethanesulfonyl), arylsulfonyl (for example, benzene-sulfonyl, 4-chlorobenzenesulfonyl or p-toluenesulfonyl), alkoxycarbonyl (for example, methoxycarbonyl, ethoxycarbonyl or butoxycarbonyl), aryloxycarbonyl (for example, phenoxycarbonyl), alkylcarbonyl (for example, acetyl, propionyl or butyroyl), arylcarbonyl (for example, benzoyl or alkylbenzoyl) or acyloxy group (for example, acetyloxy, propionyloxy or butyroyloxy).

R1 is preferably an alkyl group, an aryl group, an arylamino group and an alkoxy group.

Of $R_2$, $R_3$ and $R_4$, $R_2$ and $R_4$ are preferably hydrogen atoms.

Substituent groups for $R_1$ include the groups defined for $R_2$ to $R_4$ described above.

$R_3$ is preferably a hydrogen atom, a halogen atom, an alkyl group, an aryl group, an alkylcarbonamido group, an arylcarbonamido group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group or an acyloxy group.

The total of Hammett $\rho_P$ constants of substituent groups at the 2-, 3-, 5- and 6-positions of a benzene ring is preferably 0 or more. When a dye produced by coupling is transferred to an image receiving layer or an image receiving material of another sheet, the total number of carbon atoms of substituent groups at the 2-, 3-, 5- and 6-positions of a benzene ring is preferably 15 or less, and more preferably 8 or less.

$R_5$ represents an alkyl group (for example, methyl, ethyl, butyl, octyl, lauryl, cetyl or stearyl), an aryl group (for example, phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di(methoxycarbonyl)phenyl) or a heterocyclic group (for example, pyridyl). The number of carbon atoms of $R_5$ is preferably 6 or more, and more preferably 15 or more. The upper limit of the number of carbon atoms of $R_5$ is preferably 40.

The compound represented by general formula (I) is first dissolved in a low boiling organic solvent (for example, ethyl acetate or methyl ethyl ketone), together with a coupler and a high boiling organic solvent (for example, an alkyl phosphate ester or an alkyl phthalate ester), and the resulting solution is dispersed in water by the emulsion dispersing method well known in the art, followed by addition of the resulting dispersion. Addition by the solid dispersing method described in JP-A-63-271339 is also possible.

The amount of the compound represented by general formula (I) added is determined depending upon the ratio of the compound to the coupler. Although the amount of the coupler added depends upon the molar absorption coefficient ($\epsilon$) thereof, in order to obtain an image density of 1.0 or more as a reflective density, it is suitably about 0.001 to 100 mmol/m$^2$, preferably about 0.01 to 10 mmol/m$^2$, and more preferably about 0.05 to 5 mmol/m$^2$ as the amount of the compound applied, when the coupler produces the dye having a molar absorption coefficient ($\epsilon$) of about 5000 to 500000 by coupling. The compound represented by general formula (I), a developing agent, is added at a molar ratio of the compound to the coupler of 0.01:1 to 100:1, preferably 0.1:1 to 10:1, and more preferably 0.2:1 to 5:1.

The compounds represented by general formula (I) can be synthesized by combining several organic chemical reactions stepwise. Synthesis examples of two typical compounds are described below.

<Synthesis of Developing Agent D-1>

Developing agent D-1 was synthesized by the following synthesis route according to scheme 1.

<Scheme 1>
Synthesis of Developing Agent D-1

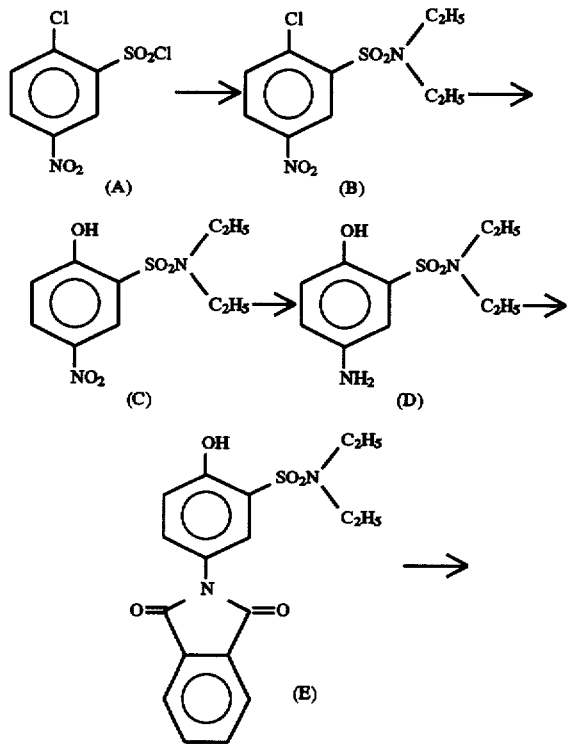

-continued

<Scheme 1>

Synthesis of Developing Agent D-1

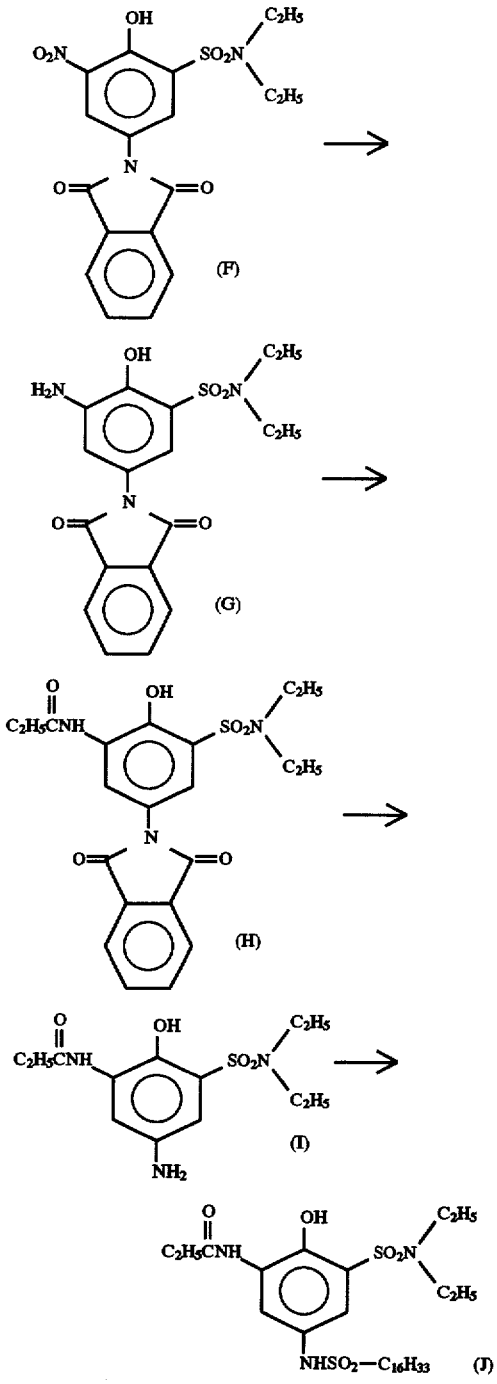

1) Compound (A)→Compound (B)

In a 1-liter three neck flask equipped with a condenser, 500 ml of acetonitrile, 73 g (1 mol) of diethylamine and 101 g (1 mol) of triethylamine were placed, and kept at 0° C. with stirring on a methanol-ice bath. Then, 269 g (1.05 mol) of compound (A) was added thereto for 1 hour. At this time, the inside of the flask was kept at a temperature of 10° C. After termination of addition, the cooling bath was removed, followed by stirring for 1 hour under the conditions of room temperature. The resulting reaction mixture was put into 10 liters of ice water, and the deposited crystals were filtered.

The crude crystals thus obtained were recrystallized from 1 liter of isopropyl alcohol to obtain 272 g of crystals of compound (B) (yield: 93%).

2) Compound (B)→Compound (C)

In a 1-liter three neck flask equipped with a condenser, 400 ml of dimethylsulfoxide and 117 g (0.4 mol) of compound (B) were placed, and compound (B) was completely dissolved in dimethylsulfoxide with stirring under the conditions of room temperature. A solution of 112 g (2 mol) of potassium hydroxide in 105 ml of water was added dropwise thereto for 10 minutes. Then, the inside of the flask was elevated to a temperature of 50° C. on a water bath, followed by reaction for 1 hour. The resulting reaction mixture was put into 6 liters of ice water containing 250 ml of 35% hydrochloric acid, and the deposited crystals were filtered. The crude crystals thus obtained were recrystallized from 300 ml of a mixed solvent of isopropyl alcohol and hexane to obtain 94 g of crystals of compound (C) (yield: 90%).

3) Compound (C)→Compound (D)

In a 3-liter three neck flask equipped with a condenser, 800 ml of isopropanol, 100 g of reduced iron powder, 10 g of ammonium chloride and 100 ml of water were placed, and gently heated in a steam bath until reflux was initiated. A solution of 100 g (0.38 mol) of compound (C) in 300 ml of isopropanol was added dropwise thereto for 30 minutes. At this time, violent reflux took place by reaction heat each time the solution was added dropwise. The solution was therefore slowly added dropwise while ascertaining the state of reflux. After termination of dropwise addition, stirring was continued for 30 minutes, followed by filtration by suction using a Nutsche funnel on which Celite was spread to separate the residual iron powder by filtration. The filtrate was concentrated to about 350 ml, and thereafter added to 3 liters of ice water. Then, the deposited crystals were separated by filtration. The crude crystals thus obtained were recrystallized from methanol to obtain 82 g of crystals of compound (D) (yield: 93%).

4) Compound (D)→Compound (E)

In a 2-liter three neck flask equipped with a condenser provided with a Dean-Stark water separator, 1 liter of toluene, 230 g (1 mol) of compound (D) and 148 g (1 mol) of phthalic anhydride were placed, and refluxed with stirring on an oil bath. At this time, the amount of distillate water was measured, and after it reached the theoretical amount (18 ml), reflux was further continued for 1 hour, followed by removing the oil bath to cool. The deposited crystals were filtered, and combined with crystals further deposited from the filtrate by removing toluene by distillation under reduced pressure. The crude crystals thus obtained were recrystallized from methanol to obtain 337 g of crystals of compound (E) (yield: 98%).

5) Compound (E)→Compound (F)

In a 1-liter three neck flask equipped with a condenser, 500 ml of acetic acid and 108 g (0.3 mol) of compound (E) were placed, and heated to 70° C. with stirring on a hot water bath. Then, 22.5 ml (0.3 mol) of concentrated nitric acid (specific gravity: 1.38, concentration: 61%) was added dropwise thereto for 1 hour. After termination of dropwise addition, the cloudy solution became clear, and thereafter, crystals were deposited. After the crystals were initiated to be deposited, the reaction was further continued for 1 hour, followed by cooling to room temperature. The crystals were filtered and washed with acetic acid to obtain 116 g of crystals of compound (F) (yield: 95%).

6) Compound (F)→Compound (G)

In a 5-liter three neck flask equipped with a condenser, 500 ml of N,N-dimethylacetamide and 122 g (0.3 mol) of compound (F) were placed, and compound (F) was completely dissolved in N,N-dimethylacetamide with stirring. Then, 1 liter of ethyl acetate was added thereto. After stirring, 2 liters of hot water of 60° C. was added, and the mixture was continued to be stirred. Then, 313 g (1.8 mol) of sodium hydrosulfite was gradually added thereto. After termination of addition, the mixture was stirred for 30 minutes, followed by separation of an ethyl acetate phase, which was washed twice with water. The ethyl acetate phase was dried with anhydrous magnesium sulfate, and thereafter, the drying agent was removed by filtration. Then, the ethyl acetate phase was concentrated to about 300 ml under reduced pressure. n-Hexane was added thereto to cool it, and the deposited crystals were separated by filtration to obtain 101 g of crystals of compound (G) (yield: 90%).

7) Compound (G)→Compound (H)

In a 1-liter three neck flask equipped with a condenser, 400 ml of acetonitrile and 150 g (0.4 mol) of compound (G) were placed, and stirred. Then, 52 g of propionic anhydride was added thereto, and refluxed in a steam bath for 1 hour. After cooling, the resulting product was put into 4 liters of ice water, and the deposited crystals were separated by filtration. The crude crystals thus obtained were recrystallized from 300 ml of a mixed solvent of ethyl acetate and hexane to obtain 169 g of crystals of compound (H) (yield: 98%).

8) Compound (H)→Compound (I)

In a 2-liter three neck flask equipped with a condenser, 1 liter of ethanol and 223 g (0.5 mol) of compound (H) were placed, and 30 g (0.53 mol) of hydrazine hydrate was added dropwise with stirring in a stream of nitrogen. On reaction with it for 1 hour under the conditions of 50° C., white phthalhydrazide was deposited. This was therefore filtered off with heating. The filtrate was cooled to 10° C. or less, and the deposited crystals were separated by filtration. The resulting crystals were washed with ethanol, and recrystallized from acetonitrile to obtain 134 g of crystals of compound (I) (yield: 85%).

9) Compound (I)→Compound (J)

In a 1-liter three neck flask equipped with an air condenser, 400 ml of acetonitrile, 158 g (0.5 mol) of compound (I) and 83 g (0.53 mol) of pyridine were placed, and stirred under the conditions of room temperature. A solution of 179 g (0.53 mol) of n-cetylsulfonyl chloride in 200 ml of acetonitrile was added dropwise thereto for 1 hour. At this time, the inside of the flask was elevated to a temperature of 35° C. Stirring was continued as such for 2 hours, followed by putting the contents into 4 liters of glacial aqueous hydrochloric acid. This was extracted with 1.5 liters of ethyl acetate to remove an aqueous phase. The ethyl acetate phase was washed with an aqueous solution of sodium bicarbonate, water and further saturated saline solution, and then, dried with anhydrous magnesium sulfate. Ethyl acetate was removed from this solution by distillation under reduced pressure, and 600 ml of methanol was added to the resulting oily substance to crystallize with stirring. Thus, 287 g of crystals of compound (J) was obtained (yield: 95%).

<Synthesis of Developing Agent D-8>

Developing agent D-8 was synthesized by the following synthesis route according to scheme 2.

<Scheme 2>
Synthesis of Developing Agent D-8

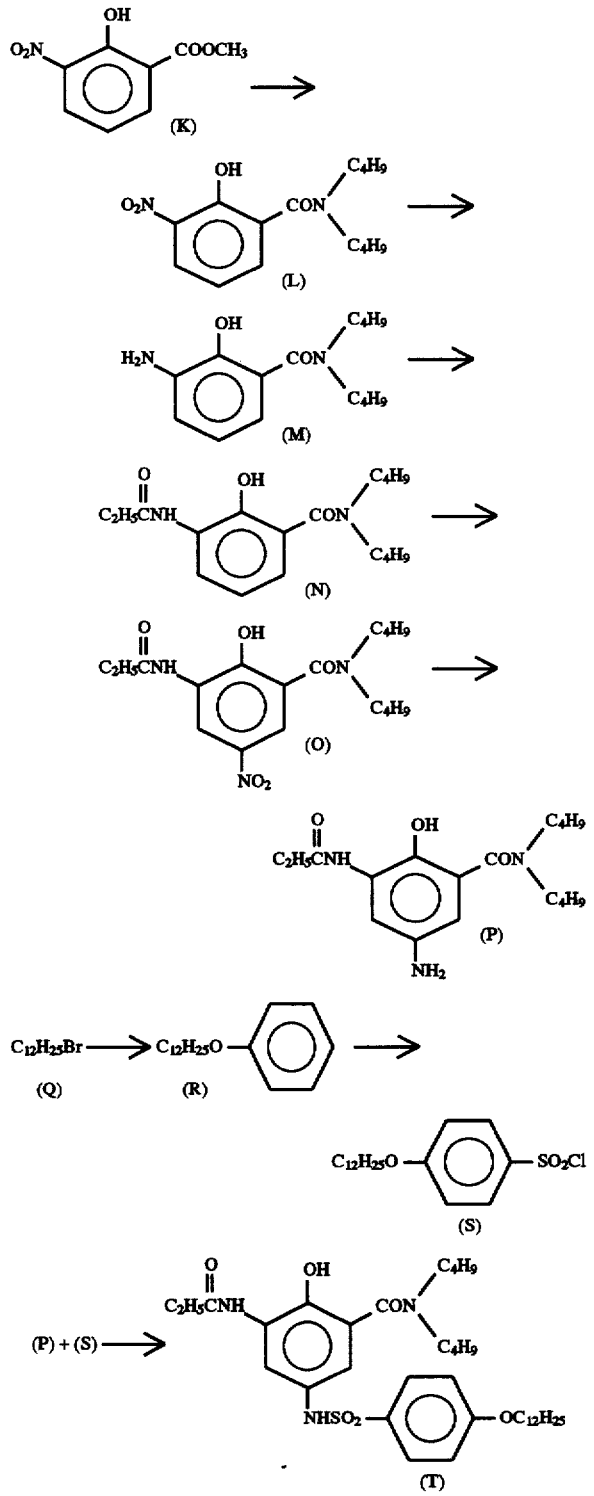

1) Compound (K)→Compound (L)

In a 1-liter three neck flask, 197 g (1.0 mol) of compound (K) and 285 g (2.0 mol) of di-n-butylamine were placed, and reacted at 100° C. for about 2 hours, maintaining the evacuated state by sucking with an aspirator with stirring. When condensation of methanol disappeared on a glass portion of the aspirator, heating was stopped and the reaction mixture was cooled to room temperature. The reaction mixture was added to 5 liters of a cold aqueous solution of diluted hydrochloric acid to form crystals, which were separated by filtration. The crude crystals thus obtained were recrystallized from methanol to obtain 271 g of crystals of compound (L) (yield: 92%).

2) Compound (L)→Compound (M)

In a 3-liter three neck flask equipped with a condenser, 800 ml of isopropanol, 100 g of reduced iron powder, 10 g of ammonium chloride and 100 ml of water were placed, and gently heated in a steam bath until reflux was initiated. A solution of 100 g (0.34 mol) of compound (L) in 300 ml of isopropanol was added dropwise thereto for 30 minutes. At this time, violent reflux took place by reaction heat each time the solution was added dropwise. The solution was therefore slowly added dropwise while ascertaining the state of reflux. After termination of dropwise addition, stirring was continued for 30 minutes, followed by filtration by suction using a Nutsche funnel on which Celite was spread to separate the residual iron powder by filtration. The filtrate was concentrated to about 350 ml, and thereafter, added to 3 liters of ice water. Then, the deposited crystals were separated by filtration. The crude crystals thus obtained were recrystallized from methanol to obtain 84 g of crystals of compound (M) (yield: 93%).

3) Compound (M)→Compound (N)

In a 1-liter three neck flask equipped with a condenser, 400 ml of acetonitrile and 132 g (0.5 mol) of compound (M) were placed, and stirred. Then, 69 g (0.53 mol) of propionic anhydride was added thereto, and refluxed in a steam bath for 1 hour. After cooling, the resulting product was put into 4 liters of ice water, and the deposited crystals were separated by filtration. The crude crystals thus obtained were recrystallized from 300 ml of ethanol to obtain 157 g of crystals of compound (N) (yield: 98%).

4) Compound (N)→Compound (O)

In a 1-liter three neck flask equipped with a condenser, 300 ml of acetic acid and 96 g (0.3 mol) of compound (N) were placed, and heated to 55° C. with stirring on a hot water bath. Then, 22.5 ml (0.3 mol) of concentrated nitric acid (specific gravity: 1.38, concentration: 61%) was added dropwise thereto for 1 hour. After termination of dropwise addition, the cloudy solution became clear, and thereafter, crystals were deposited. After the crystals were initiated to be deposited, the reaction was further continued for 1 hour, followed by cooling to room temperature. The crystals were filtered and recrystallized from 250 ml of acetonitrile to obtain 98 g of crystals of compound (O) (yield: 90%).

5) Compound (O)→Compound (P)

In a 5-liter three neck flask equipped with a condenser, 1300 ml of isopropanol, 150 g of reduced iron powder, 15 g of ammonium chloride and 150 ml of water were placed, and gently heated in a steam bath until reflux was initiated. A solution of 150 g (0.41 mol) of compound (0) in 500 ml of isopropanol was added dropwise thereto for 40 minutes. At this time, violent reflux took place by reaction heat each time the solution was added dropwise. The solution was therefore slowly added dropwise while ascertaining the state of reflux. After termination of dropwise addition, stirring was continued for 30 minutes, followed by filtration by suction using a Nutsche funnel on which Celite was spread to separate the residual iron powder by filtration. The filtrate was concentrated to about 500 ml, and thereafter, added to 5 liters of ice water. Then, the deposited crystals were separated by filtration. The crude crystals thus obtained were recrystallized from 300 ml of ethanol to obtain 126 g of crystals of compound (P) (yield: 92%).

6) Compound (Q)→Compound (R)

In a 5-liter three neck flask equipped with a condenser, 1500 ml of acetonitrile, 300 ml of polyethylene glycol (polymerization degree: 400), 235 g (2.5 mol) of phenol, 498 g (2 mol) of lauroyl bromide [compound (Q)] and 345 g (2.5 mol) of potassium carbonate were placed, and refluxed in a steam bath for 4 hours. After cooling, the resulting product was extracted twice with 700 ml of n-hexane, and the hexane phases were collected. This was washed with 0.1 N aqueous solution of sodium hydroxide, water and further saturated saline solution, and then, dried with anhydrous magnesium sulfate. n-Hexane was removed from this solution by distillation under reduced pressure to obtain 514 g of oily compound (R) (yield: 98%).

7) Compound (R)→Compound (S)

In a 3-liter three neck flask equipped with a condenser, 1 liter of dichloromethane and 262 g (1 mol) of compound (R) were placed, and the inside of the flask was kept at a temperature of 0° C. with stirring on a methanol-ice bath. Then, 256 g (2.2 mol) of chlorosulfonic acid was added dropwise thereto for 2 hours. At this time, the inside of the flask was kept at a temperature of 10° C. or less. After dropwise addition, the cooling bath was removed, and the reaction was further continued for 2 hours at room temperature. The contents were put into 5 liters of ice water, and this was extracted with 4 liters of a mixed solvent of ethyl acetate and n-hexane. The oil phase was washed with saturated saline solution, and then, dried with anhydrous magnesium sulfate. Ethyl acetate and n-hexane were removed from this solution by distillation under reduced pressure to obtain an oily substance. This substance was crystallized from 500 ml of acetonitrile to obtain 307 g of crystals of compound (S) (yield: 85%).

8) Compound (P)+Compound (S)→Compound (T)

In a 1-liter three neck flask equipped with a condenser, 500 ml of acetonitrile, 134 g (0.4 mol) of compound (P) and 152 g (0.42 mol) of compound (S) were placed, and stirred under the conditions of room temperature. Then, 34 g (0.42 mol) of pyridine was added dropwise for 30 minutes. After dropwise addition, the mixture was stirred for 2 hours, followed by addition of the reaction mixture to 3 liters of cold water. When crystals were deposited, they were separated by filtration, and recrystallized from 500 ml of methanol to obtain 243 g of crystals of developing agent D-8 [compound (T)].

Examples of the compounds represented by general formula (I) are shown below, but the compounds used in the present invention are not, of course, limited thereby.

D-1

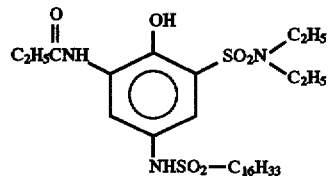

D-2

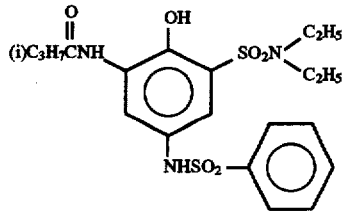

-continued
D-3
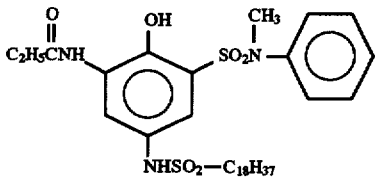
D-4
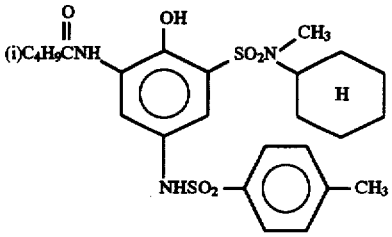
D-5
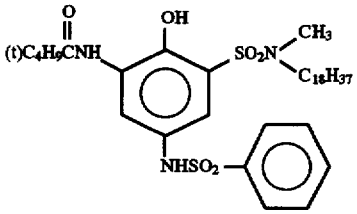
D-6
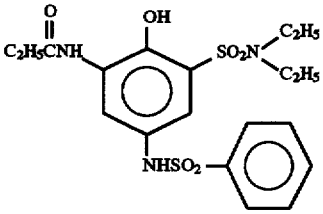
D-7
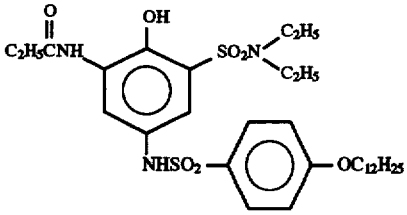
D-8
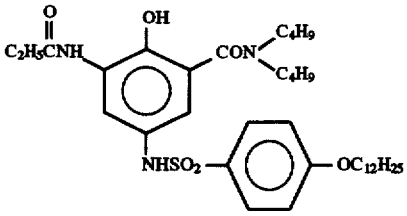
D-9
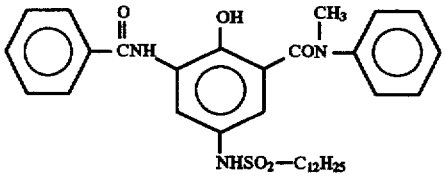
-continued
D-10
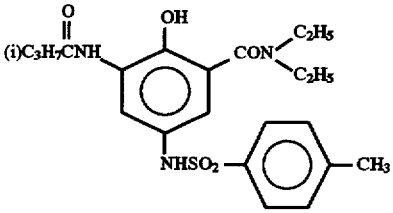
D-11
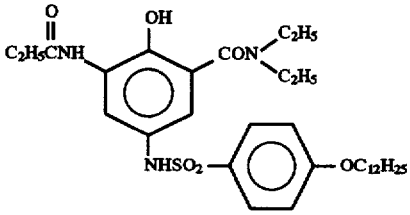
D-12
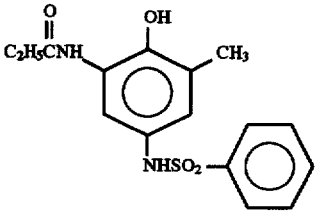
D-13
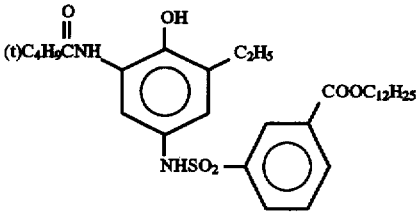
D-14
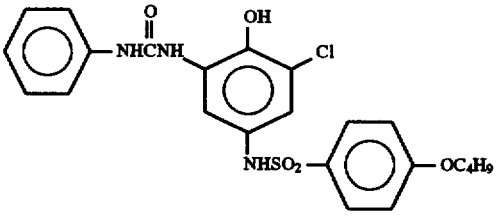
D-15
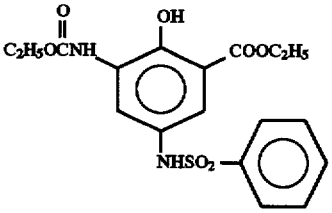
D-16
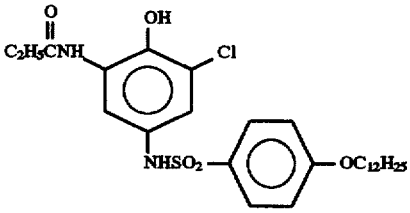

-continued

D-17

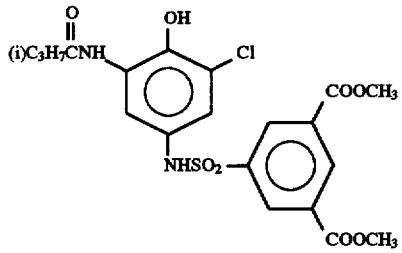

D-18

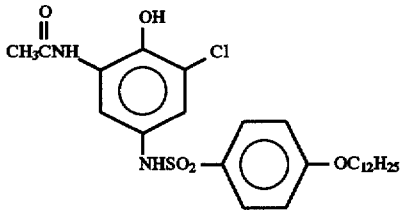

D-19

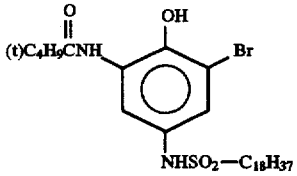

D-20

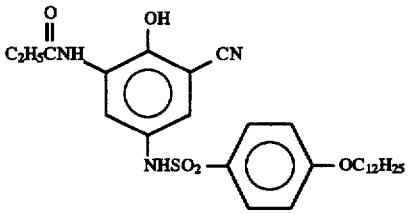

D-21

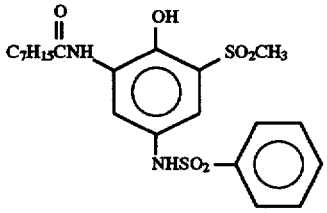

D-22

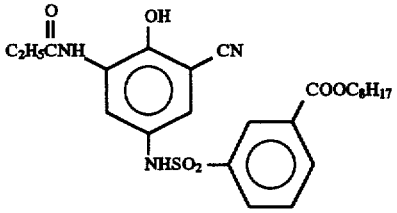

D-23

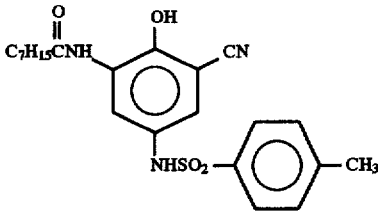

-continued

D-24

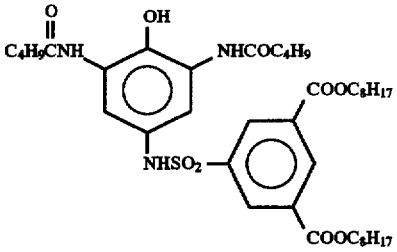

D-25

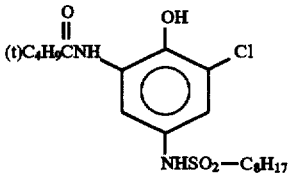

In the present invention, compounds which form dyes by oxidation coupling reaction (couplers) are used as dye donative compounds. Although the couplers may be either four-equivalent couplers or two-equivalent couplers, the four-equivalent couplers are preferred in the present invention for the following reasons. First, an amino group, a coupling site of a reducing agent, is protected with a sulfonyl group in the present invention. If a coupling site of the coupler has a substituent group in coupling, reaction is inhibited by steric hindrance. Secondary, the sulfonyl group is removed as a sulfinic acid after coupling, so that a removable group of the coupler must be removed as a cation. A usual two-equivalent coupler can not be such a removable group. Examples of both the four-equivalent and two-equivalent couplers are described in detail in *Theory of the Photographic Process*, 4th ed., edited by T. H. James, pages 291 to 334 and 354 to 361, Macmillan, 1977, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Preferred examples of the couplers used in the present invention are enumerated below.

Compounds having structures as represented by the following general formulas (1) to (12) are preferably used as the couplers in the present invention. These are compounds named generically active methylene, pyrazolone, pyrazoloazole, phenol, naphthol and pyrrolotriazole, respectively, and are well known in the art.

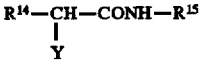

(1)

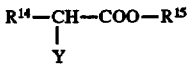

(2)

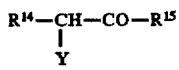

(3)

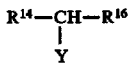

(4)

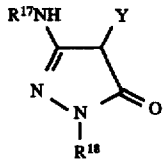

(5)

-continued (6)

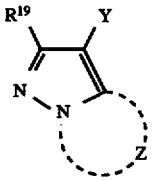

(7)

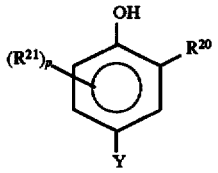

(8)

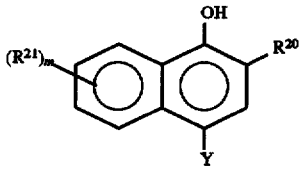

(9)

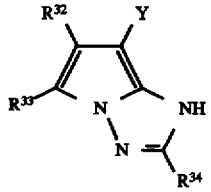

(10)

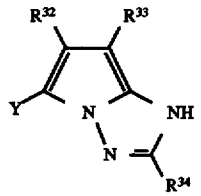

(11)

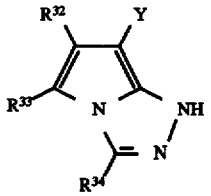

(12)

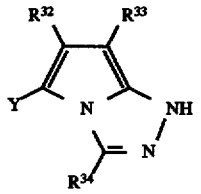

General formulas (1) to (4) indicate couplers referred to as active methylene couplers, wherein $R^{14}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may have a substituent group.

In general formulas (1) to (3), $R^{15}$ is an alkyl group, an aryl group or a heterocyclic group, which may have a substituent group.

In general formula (4), $R^{16}$ is an aryl group or a heterocyclic group, which may have a substituent group.

The substituent groups which $R^{14}$, $R^{15}$ and $R^{16}$ may have include various substituent groups such as alkyl, alkenyl alkynyl, aryl, heterocyclic, alkoxyl, aryloxy, cyano, acylamino, sulfonamido, carbamoyl, sulfamoyl, alkoxycarbonyl, aryloxycarbonyl, alkylamino, arylamino, hydroxyl and sulfo groups and halogen atoms.

Preferred examples of $R^{14}$ include acyl, cyano, carbamoyl and alkoxycarbonyl groups.

In general formulas (1) to (4), Y is a hydrogen atom or a group removable by a coupling reaction with a developing agent oxidant. Examples of Y include a carboxyl group, a formyl group, halogen atoms (for example, bromine and iodine), a carbamoyl group, methylene groups having substituent groups (the substituent groups include, for example, aryl, sulfamoyl, carbamoyl, alkoxy, amino and hydroxyl groups), acyl groups and a sulfo group. Of these, Y is preferably a hydrogen atom.

In general formulas (1) to (4), $R^{14}$ and $R^{15}$, or $R^{14}$ and $R^{16}$ may combine together to form a ring.

General formula (5) represents couplers called 5-pyrazolone magenta couplers. In general formula (5), $R^{17}$ represents an alkyl group, an aryl group, an acyl group or a carbamoyl group. $R^{18}$ represents a phenyl group or a phenyl group having at least one halogen atom, an alkyl group, a cyano group, an alkoxy group, an alkoxycarbonyl group or an acylamino group as a substituent group. Y is the same as with general formulas (1) to (4).

Of the 5-pyrazolone magenta couplers represented by general formula (5), couplers are preferred in which $R^{17}$ is an aryl group or an acyl group, $R^{18}$ is a phenyl group having at least one halogen atom as a substituent group, and Y is a hydrogen atom.

These preferred groups are described in detail. $R^{17}$ is an aryl group such as phenyl, 2-chlorophenyl, 2-methoxyphenyl, 2-chloro-5-tetradecaneamidophenyl, 2-chloro-5-(3-octadecenyl-1-succinimido)phenyl, 2-chloro-5-octadecylsulfon-amidophenyl or 2-chloro-5-[2-(4-hydroxy-3-t-butylphenoxy)-tetradecaneamido]phenyl, or an acyl group such as acetyl, pivaloyl, tetradecanoyl, 2-(2,4-di-t-pentylphenoxy)acetyl, 2-(2,4-di-t-pentylphenoxy)butanoyl, benzoyl or 3-(2,4-di-t-amylphenoxyacetazido)benzoyl. These groups may further have substituent groups, each of which is an organic substituent group linked through a carbon atom, an oxygen atom, a nitrogen atom or a sulfur atom, or a halogen atom.

$R^{18}$ is preferably a substituted phenyl group such as 2,4,6-trichlorophenyl, 2,5-dichlorophenyl or 2-chlorophenyl.

General formula (6) represents couplers called pyrazoloazole couplers. In general formula (6), $R^{19}$ represents a hydrogen atom or a substituent group. Z represents a group of nonmetal atoms necessary for forming a 5-membered azole ring containing 2 to 4 nitrogen atoms, and said azole ring may have a substituent group (including a condensed ring). Y is the same as with general formulas (1) to (4).

Of the pyrazoloazole couplers represented by general formula (6), imidazo[1,2-b]pyrazoles described in U.S. Pat. No. 4,500,630, pyrazolo[1,5-b][1,2,4]triazoles described in U.S. Pat. No. 4,540,654 and pyrazolo[5,1-c][1,2,4]triazoles described in U.S. Pat. No. 3,725,067 are preferred with respect to absorption characteristics of color developing dyes. Of these, pyrazolo[1,5-b][1,2,4]triazoles are preferred with respect to light fastness.

Details of the substituent groups of the azole ring represented by $R^{19}$, Y and Z are described, for example, in U.S. Pat. No. 4,540,654, the second column, line 41 to the eighth column, line 27.

Preferred examples thereof include pyrazoloazole couplers in each of which a branched alkyl group is directly connected to the 2-, 3- or 6-position of a pyrazolotriazole ring as described in JP-A-61-65245, pyrazoloazole couplers containing sulfonamido groups in their molecules described in JP-A-61-65245, pyrazoloazole couplers having alkoxyphenylsulfonamido ballast groups described in JP-A-61-147254, pyrazolotriazole couplers each having an alkoxy group or an aryloxy group at the 6-position described in JP-A-62-209457 or JP-A-63-307453, and pyrazolotriazole couplers having carbonamido groups in their molecules described in JP-A-2-201443.

General formulas (7) and (8) represent couplers called phenol couplers and naphthol couplers, respectively. In the formulas, $R^{20}$ represents a hydrogen atom or a group selected from the group consisting of $-NHCOR^{22}$, $-SO_2NR^{22}R^{23}$, $NHSO_2R^{22}$, $-NHCOR^{22}$, $-NHCONR^{22}R^{23}$ and $-NHSO_2NR^{22}R^{23}$. $R^{22}$ and $R^{23}$ each represents a hydrogen atom or a substituent group. In general formulas (7) and (8), $R^{21}$ represents a substituent group, p represents an integer selected from 0 to 2, and m is an integer selected from 0 to 4. Y is the same as in general formulas (1) to (4). Substituent groups for $R^{21}$ to $R^{23}$ include the substituent groups for $R^{14}$ to $R^{16}$ described above.

Preferred examples of the phenol couplers represented by general formula (7) include 2-alkylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent (OLS) 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol couplers represented by general formula (8) include 2-carbamoyl-1-naphthol couplers described in U.S. Pat. Nos. 2,474,293, 4,052,212, 4,146,396, 4,228,233 and 4,296,200, and 2-carbamoyl-5-amido-1-naphthol couplers described in U.S. Pat. No. 4,690,889.

General formulas (9) to (12) represent couplers called pyrrolotriazole couplers. In general formulas (9) to (12), $R^{32}$, $R^{33}$ and $R^{34}$ each represents a hydrogen atom or a substituent group. Y is the same as in general formulas (1) to (4). Substituent groups for $R^{32}$, $R^{33}$ and $R^{34}$ include the substituent groups for $R^{14}$ to $R^{16}$ described above.

Preferred examples of the pyrrolotriazole couplers represented by general formulas (9) to (12) include couplers in each of which at least one of $R^{32}$ and $R^{33}$ is an electron attractive group, which are described in European Patents 488248A1, 491197A1 and 545300. In addition, couplers having structures such as cyclocondensed phenol, imidazole, pyrrole, 3-hydroxypyridine, active methine, 5,5-cyclocondensed heterocycles and 5,6-cyclocondensed heterocycles can be used.

As the cyclocondensed phenol couplers, couplers described in U.S. Pat. Nos. 4,327,173, 4,564,586 and 4,904,575 can be used.

As the imidazole couplers, couplers described in U.S. Pat. Nos. 4,818,672 and 5,051,347 can be used.

As the pyrrole couplers, couplers described in JP-A-4-188137 and JP-A-190347 can be used.

As the 3-hydroxypyridine couplers, couplers described in JP-A-1-315736 can be used.

As the active methine couplers, couplers described in U.S. Pat. Nos. 5,104,783 and 5,162,196 can be used.

As the 5,5-cyclocondensed heterocycle couplers, pyrrolopyrazole couplers described in U.S. Pat. No. 5,164,286 and pyrroloimidazole couplers described in JP-A-4-174429 can be used.

As the 5,6-cyclocondensed heterocycle couplers, pyrazolopyrimidine couplers described in U.S. Pat. No. 4,950,585, pyrrolotriazine couplers described in JP-A-4-204730, and couplers described in European Patent 556700 can be used.

In the present invention, besides the above-mentioned couplers, couplers can also be used which are described in West German Patents 3,819,051A and 3,823,049, U.S. Pat. Nos. 4,840,883, 5,024,930, 5,051,347 and 4,481,268, European Patents 304856A2, 329036, 354549A2, 374781A2, 379110A2 and 386930A1, JP-A-63-141055, JP-A-64-32260, JP-A-64-32261, JP-A--297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732.

Examples of the couplers which can be used in the present invention are shown below, but the present invention are not, of course, limited thereby.

C-1

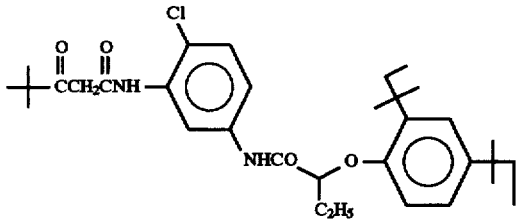

C-2

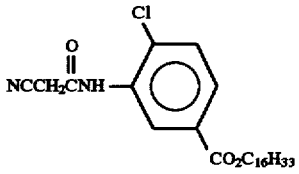

-continued
C-3
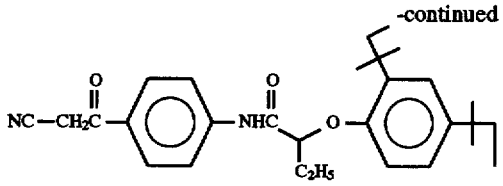
C-4
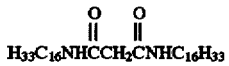
C-5
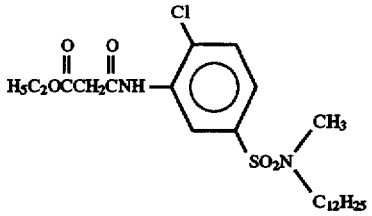
C-6
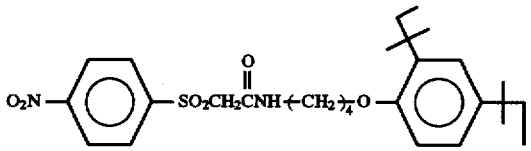
C-7
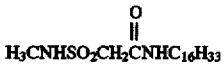
C-8
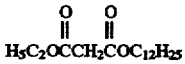
C-9
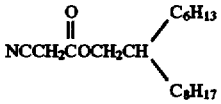
C-10
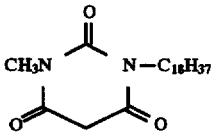
C-11
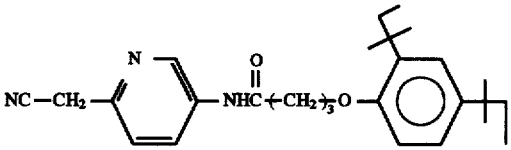
C-12
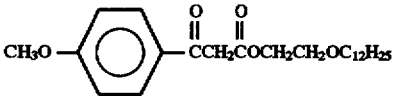
C-13
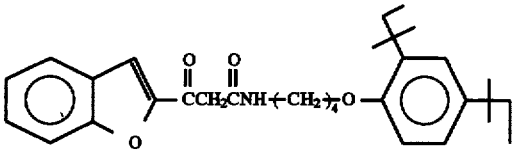
C-14
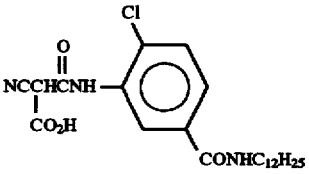

-continued
C-15
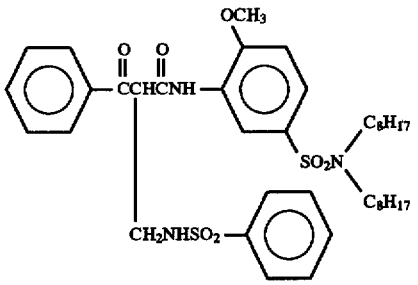
C-16
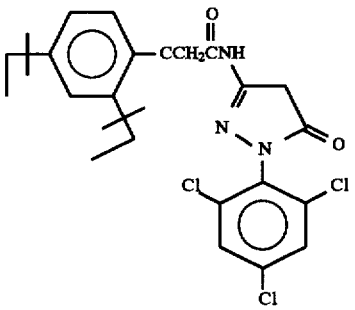
C-17
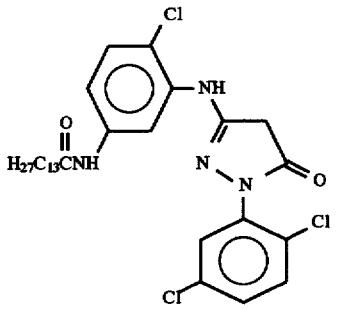
C-18
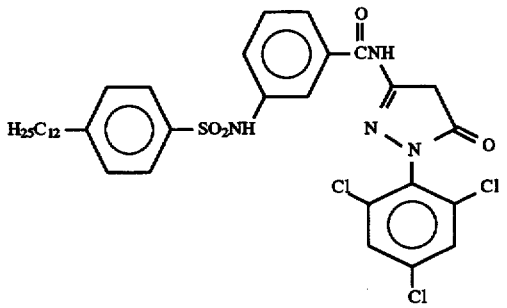
C-19
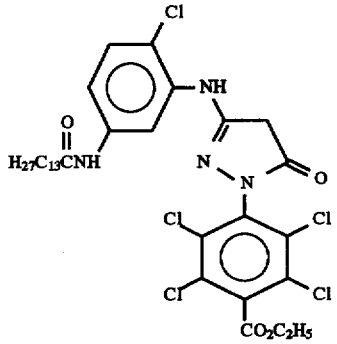

-continued
C-20
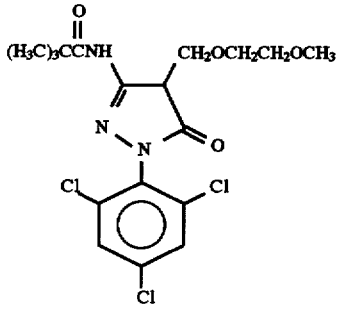
C-21
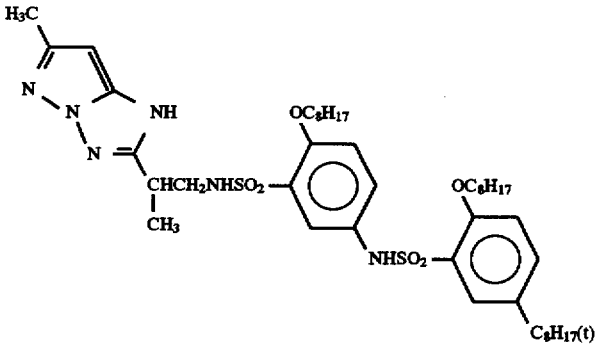
C-22
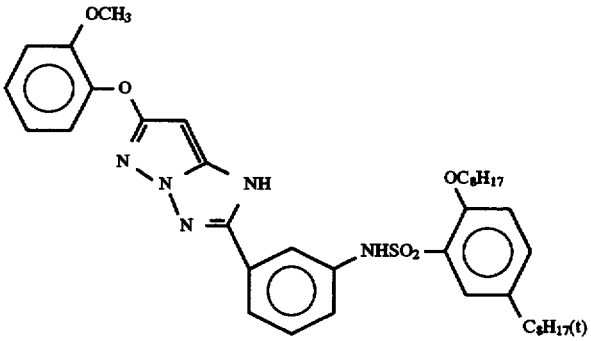
C-23
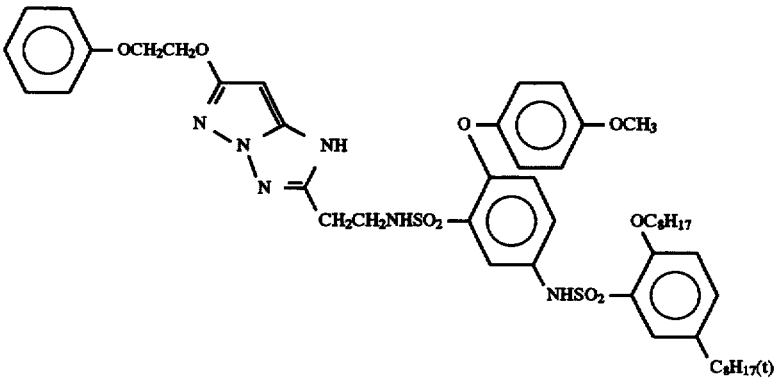
C-24
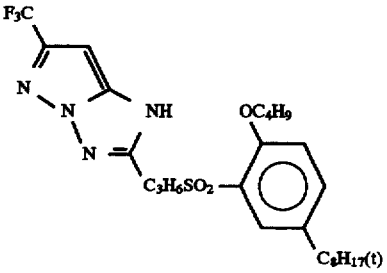

-continued
C-25
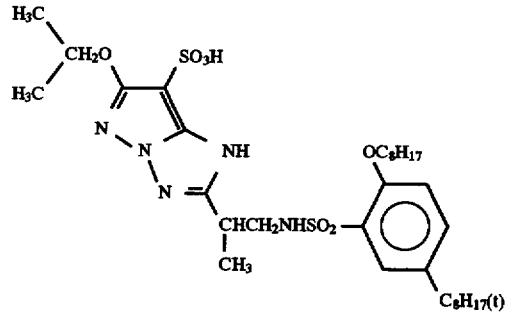
C-26
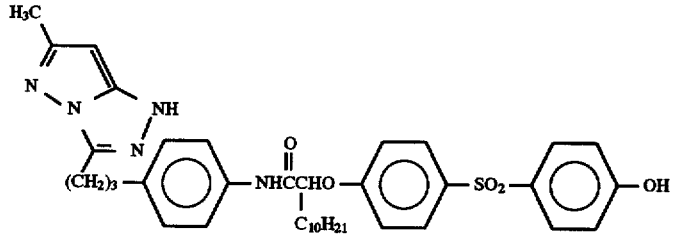
C-27
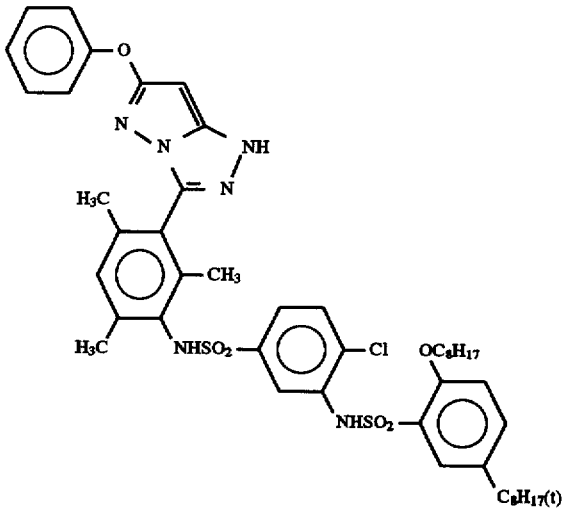
C-28
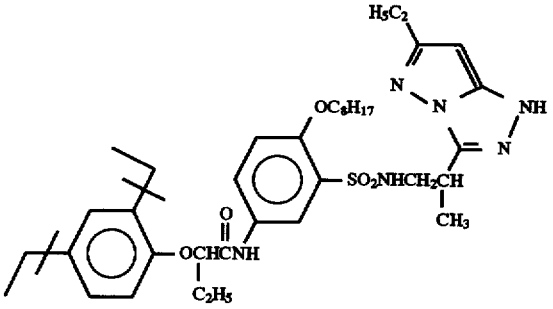

-continued
C-29
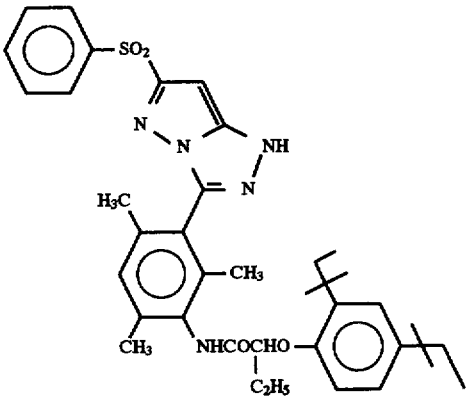
C-30
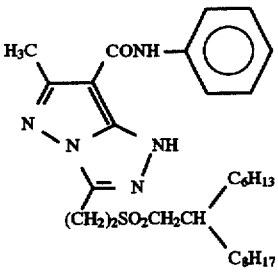
C-31
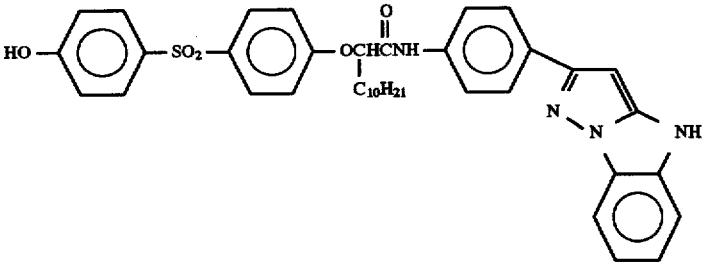
C-32
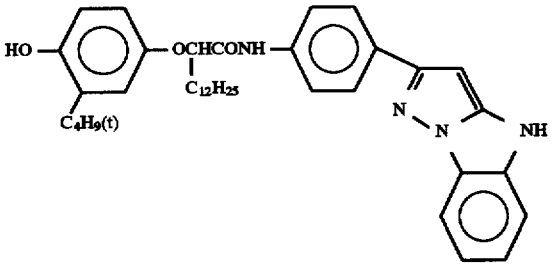
C-33
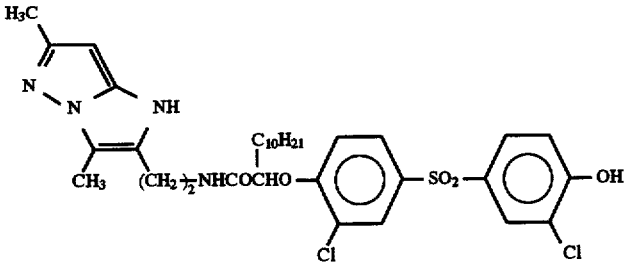

-continued
C-34
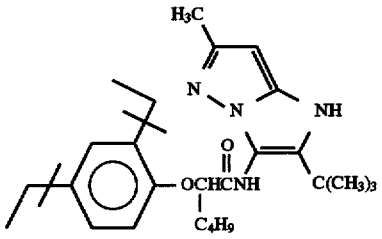
C-35
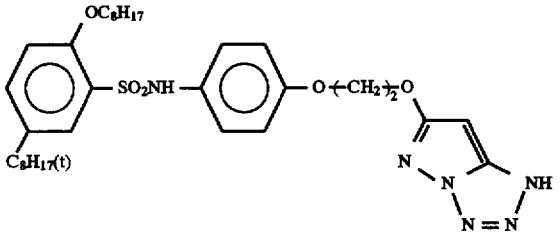
C-36
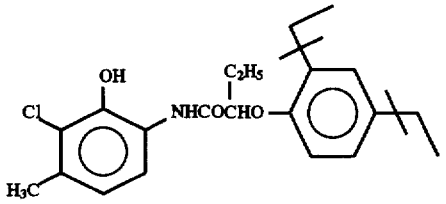
C-37
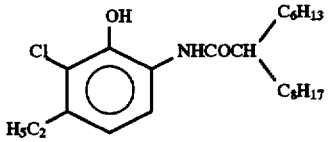
C-38
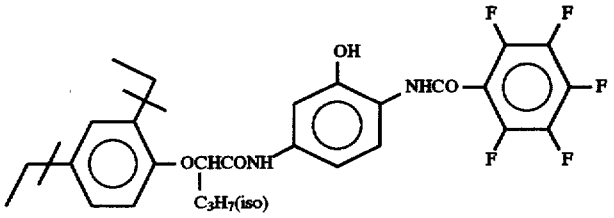
C-39
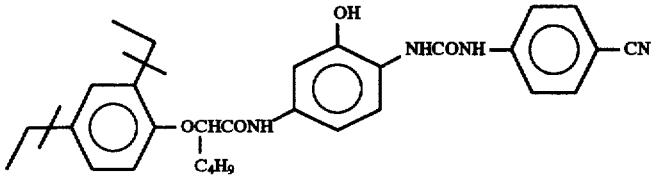
C-40
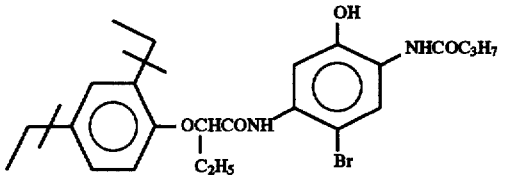
C-41
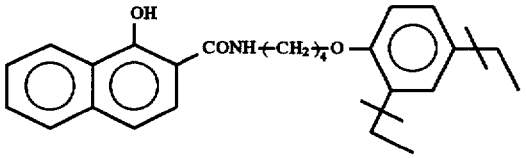

-continued
C-42
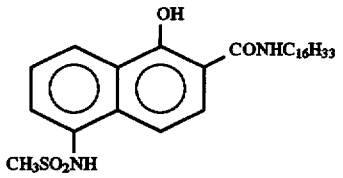
C-43
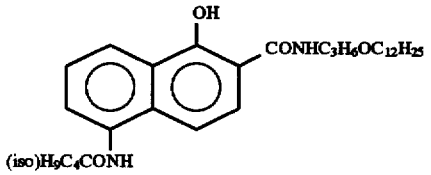
C-44
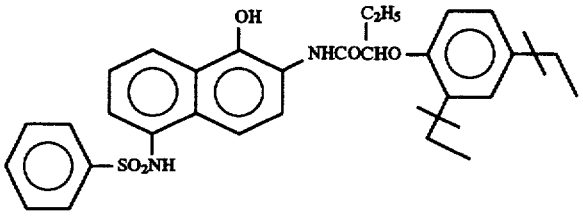
C-45
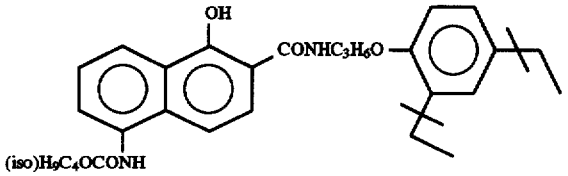
C-46
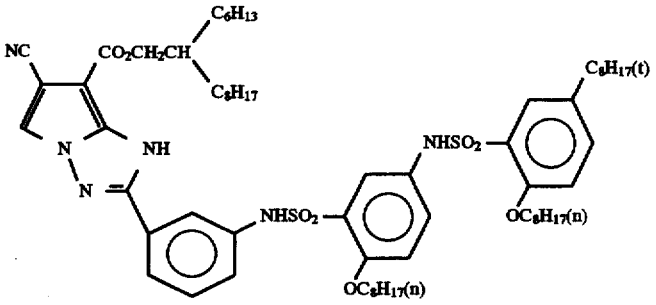
C-47
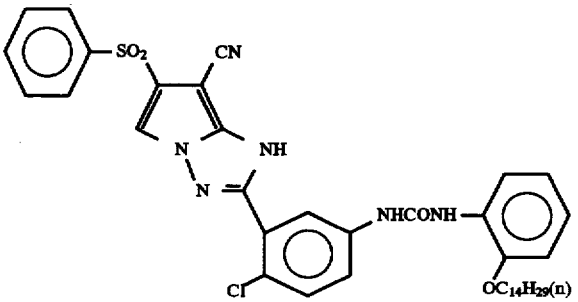

-continued
C-48
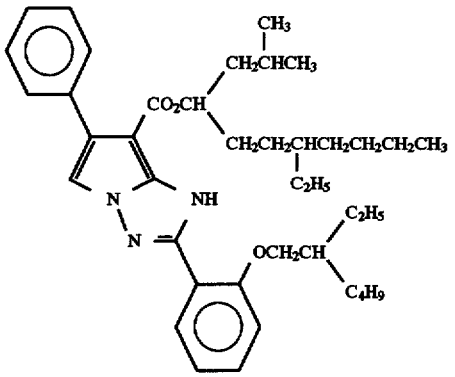
C-49
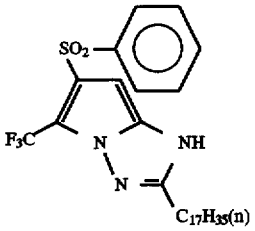
C-50
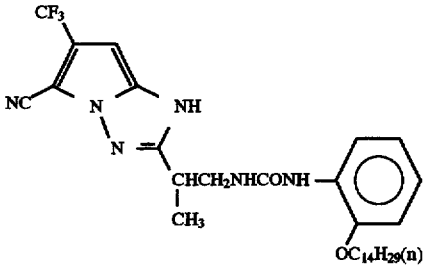
C-51
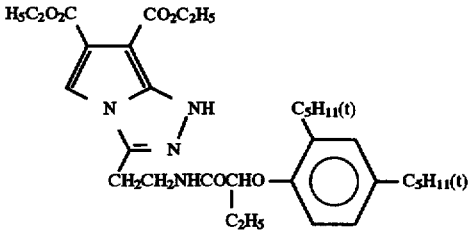
C-52
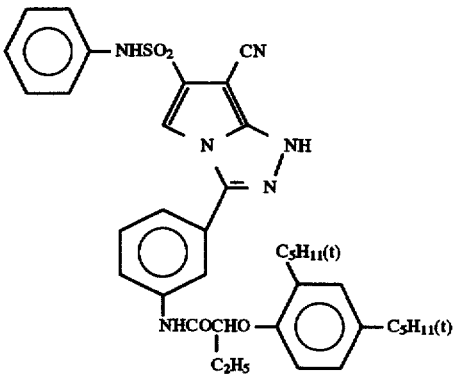

-continued
C-53
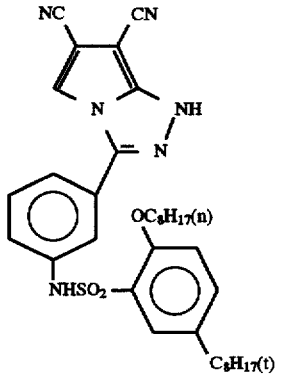
C-54
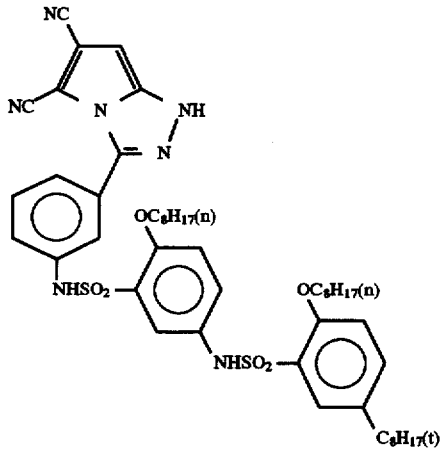
C-55
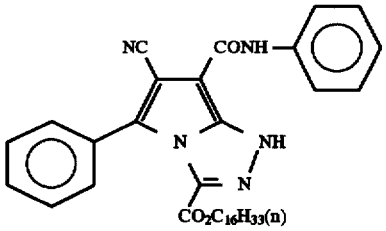
C-56
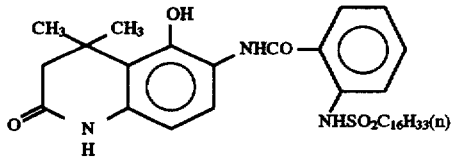
C-57
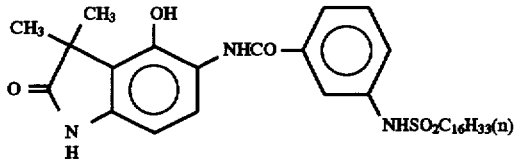
C-58
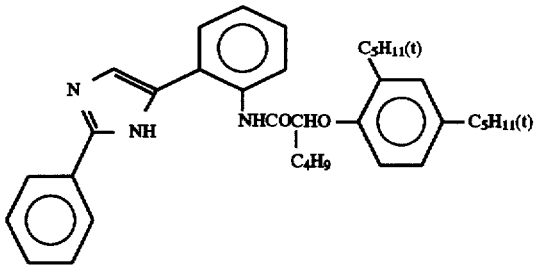

-continued
C-59
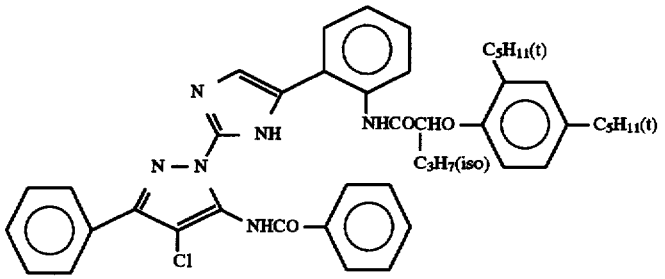
C-60
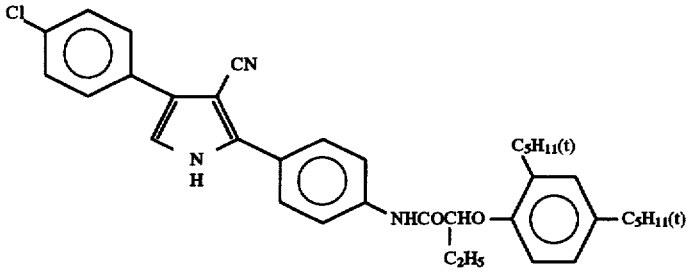
C-61
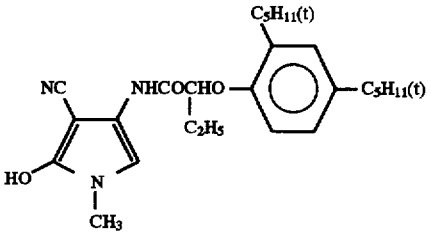
C-62
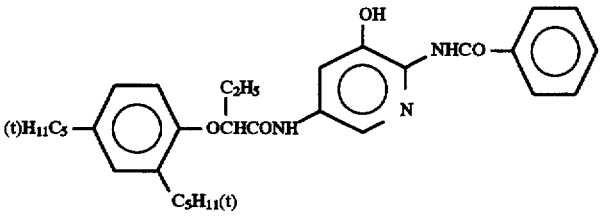
C-63
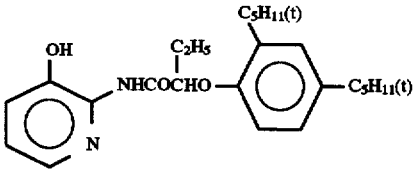
C-64
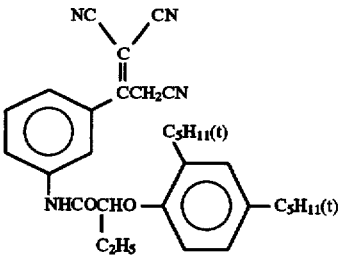
C-65
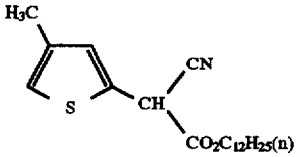

-continued
C-66
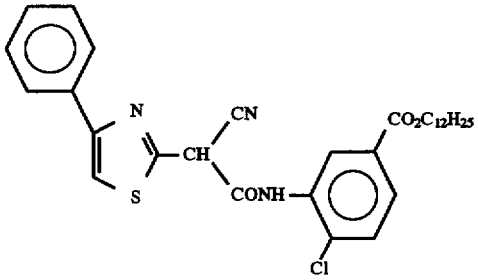
C-67
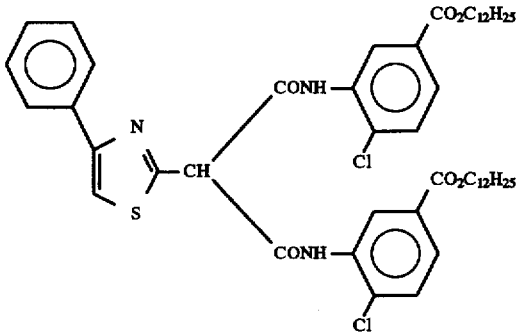
C-68
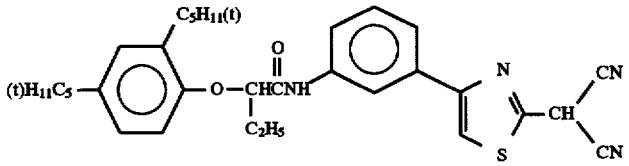
C-69
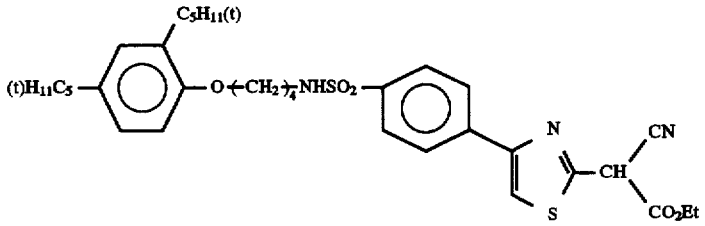
C-70
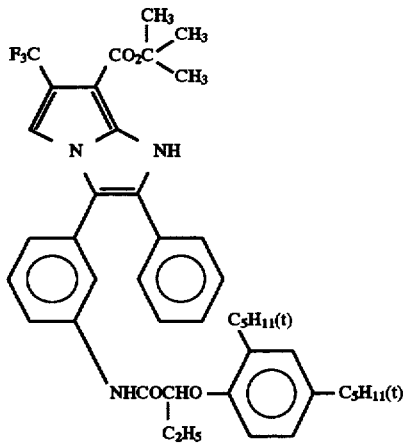

-continued

C-71

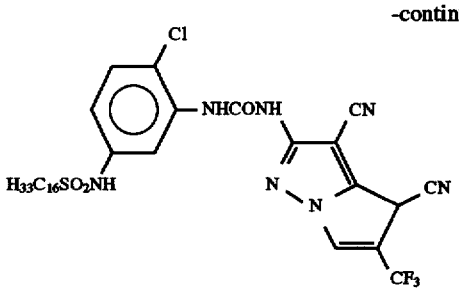

C-72

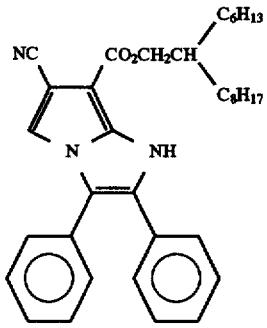

C-73

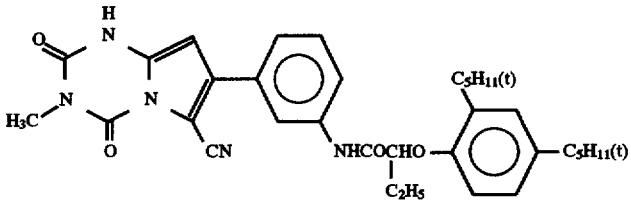

C-74

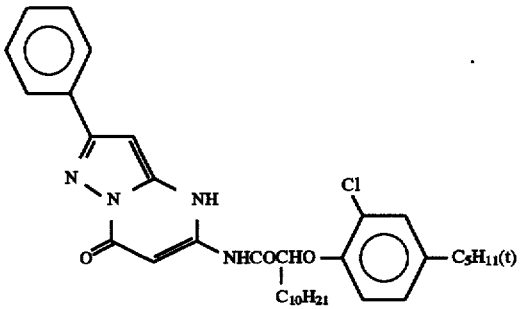

C-75

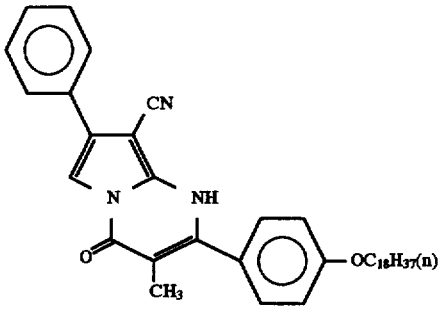

The color photographic materials of the present invention basically have light-sensitive silver halides, couplers as dye donating compounds, reducing agents and binders on supports, and can further contain organic metal salt oxidizing agents as needed. These components are added to the same layers in many cases. However, they can be divided to add them to separate layers as long as they are in a reactive state.

In order to obtain a wide range of colors on the chromaticity diagram using the three primary colors of yellow, magenta and cyan, at least three silver halide emulsion layers each having light sensitivity in different spectrum regions are used in combination. For example, a combination of the three layers of a blue-sensitive layer, a green-sensitive layer and a red-sensitive layer, or a combination of a green-sensitive layer, a red-sensitive layer and an infrared-sensitive layer is used. The respective layers can be variously disposed in order as known in the usual color photographic materials. Further, each of these respective light-sensitive layers may be divided into two or more layers as needed.

The photographic materials can be provided with various supplementary layers such as protective layers, undercoat layers, intermediate layers, antihalation layers and back layers. Further, in order to improve color separation, various filter dyes can also be added.

A silver halide emulsion which can be used in the present invention may be any of silver chloride, silver bromide, silver iodobromide, silver chlorobromide, silver chloroiodide and silver chloroiodobromide.

The silver halide emulsions used in the present invention may be either surface latent image type emulsions or internal latent image type emulsions. The internal latent image type emulsions are used as direct reversal emulsions in combination with nucleating agents or light fogging. Further, they may be so-called core/shell emulsions in which the insides of grains are different from the surfaces thereof in the phase, and silver halides different in composition may be joined by epitaxial junction. Further, the silver halide emulsions may be either monodisperse emulsions or polydisperse emulsions, and methods are preferably used in which monodisperse emulsions are mixed to adjust gradation as described in JP-A-1-167743 and JP-A-4-223463. The grain size is preferably 0.1 to 2 μm, and more preferably 0.2 to 1.5 μm. The silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, there can be used any of silver halide emulsions prepared by methods described in U.S. Pat. No. 4,500,626, column 50, U.S. Pat. No. 4,628,021, *Research Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, F. Glafkides, *Chemie et Phisigue Photographigue* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

In the course of preparation of the light-sensitive silver halide emulsions of the present invention, so-called salt removal for removing excess salts is preferably conducted. As means for this, water washing with noodle may be used which is conducted by gelation of gelatin, and precipitation methods may also be used utilizing multiply charged anionic inorganic salts (for example, sodium sulfate), anionic surfactants, anionic polymers (for example, sodium polystyrenesulfonate) or gelatin derivatives (for example, aliphatic acylated gelatin, aromatic acylated gelatin and aromatic carbamoylated gelatin). The precipitation methods are preferably used.

For various purposes, the light-sensitive silver halide emulsions may contain heavy metals such as iridium, rhodium, platinum, cadmium, zinc, thallium, lead, iron and osmium. These heavy metals may be used alone or in combination. The amount added is generally about $10^{-9}$ to $10^{-3}$ mol per mol of silver halide, although it depends on the purpose of use. They may be uniformly added to grains or localized in the insides or surfaces of grains. Specifically, emulsions described in JP-A-2-236542, JP-A-1-116637 and JP-A-5-181246 are preferably used.

In the grain forming stage of the light-sensitive silver halide emulsions of the present invention, rhodanides, ammonia, 4-substituted thioether compounds, organic thioether derivatives described in JP-B-47-11386 (the term "JP-B" as used herein means an "examined Japanese patent publication") or sulfur-containing compounds described in JP-A-53-144319 can be used as solvents for silver halides.

For other conditions, reference can be made to the descriptions of P. Glafkides, *Chemie et Phisigue Photographigue* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. That is, any of an acid process, a neutral process and an ammonia process may be used. A soluble silver salt and a soluble halogen salt may be reacted with each other by using any of a single jet process, a double jet process and a combination thereof. In order to obtain monodisperse emulsions, the double jet process is preferably used.

A reverse mixing process in which grains are formed in the presence of excess silver ions can also be used. As a type of double jet process, there can also be used a process for maintaining the pAg in a liquid phase constant, in which a silver halide is formed, namely a so-called controlled double jet process.

In order to speed growth of grains, the concentration, the amount and the rate of silver salts and halogen salts added may be increased (JP-A-55-142329, JP-A-55-158124 and U.S. Pat. No. 3,650,757).

Reaction solutions may be stirred by any of the known stirring methods. The temperature and the pH of the reaction solutions during formation of silver halide grains may be arbitrarily established depending on the purpose. The pH range is preferably 2.2 to 8.5, and more preferably 2.5 to 7.5.

Light-sensitive silver halide emulsions are usually chemically sensitized. For chemical sensitization of the light-sensitive silver halide emulsions of the present invention, chalcogen sensitization such as sulfur sensitization, selenium sensitization or tellurium sensitization, noble metal sensitization using gold, platinum, palladium, etc. and reduction sensitization can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant set out below can be added after chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsions used in the present invention is preferably 1 mg to 10 g/m$^2$ in terms of silver.

In order to give the color sensitivities of green, red and infrared sensitivities to the light-sensitive silver halide emulsions used in the present invention, the light-sensitive silver halide emulsions are spectrally sensitized with methine dyes or the like. Further, spectral sensitization of a blue region may be applied to blue-sensitive emulsions as needed.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for supersensitization and wavelength adjustment of spectral sensitivity.

The emulsions may contain dyes having no color sensitization themselves or compounds which do not substantially absorb visible light and exhibit supersensitization, in combination with the sensitizing dyes (for example, ones described in U.S. Pat. No. 3,615,641 and JP-A-63-23145).

These sensitizing dyes may be added to the emulsions during, before or after chemical ripening, or before or after nucleation of the silver halide grains according to U.S. Pat. Nos. 4,183,756 and 4,225,666. These sensitizing dyes and supersensitizers may be added as solutions in organic solvents such as methanol, dispersions in gelatin or solutions in surfactants. The sensitizing agents are generally added in an amount of about $10^{-8}$ to about $10^{-2}$ mol per mol of silver halide.

Additives used in such processes and known photographic additives which can be used in the heat development photographic materials of the present invention and dye fixing materials are described in RD, No. 17643, ibid., No. 18716 and ibid., No. 307105 described above and corresponding portions thereof are summarized in the following table.

| Type of Additives | RD17643 | RD18716 | RD307105 |
|---|---|---|---|
| 1. Chemical Sensitizers | p.23 | p.648, right column | p.866 |
| 2. Sensitivity Increasing Agents | | p.648, right column | |
| 3. Spectral Sensitizers, Supersensitizers | pp.23–24 | p.648, right column to p.649, right column | pp.866–868 |
| 4. Fluorescent Brightening Agents | p.24 | p.648, right column | p.868 |
| 5. Antifoggants, Stabilizers | pp.24–25 | p.649, right column | pp.868–870 |
| 6. Light Absorbers, Filter dyes, UV Absorbers | pp.25–26 | p.649, right column to p.650, left column | p.873 |
| 7. Dye Image Stabilizers | p.25 | p.650, left column | p.872 |
| 8. Hardeners | p.26 | p.651, left column | pp.874–875 |
| 9. Binders | p.26 | p.651, left column | pp.873–874 |
| 10. Plasticizers, Lubricants | p.27 | p.650, right column | p.876 |
| 11. Coating Aids, Surfactants | pp.26–27 | p.650 right column | pp.875–876 |
| 12. Antistatic Agents | p.27 | p.650 right column | pp.876–877 |
| 13. Matte Agents | | | pp.878–879 |

As the binders for the layers constituting the heat development photographic materials, hydrophilic binders are preferably used. Examples thereof include binders described in Research Disclosures stated above and JP-A-64-13546, pages 71 to 75. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3M$ (wherein M represents a hydrogen atom or an alkali metcopolymercopolymers of these vinyl monomers with each other or with other monomers (for example, sodium methacrylate, ammonium methacrylate and Sumikagel L-5H manufactured by Sumitomo Chemical Co, Ltd.). These binders can be used in combination. In particular, combinations of gelatin and the above-mentioned binders are preferred. Gelatin is selected from lime-treated gelatin, acid-treated gelatin and so-called delimed gelatin reduced in content of calcium, etc., depending on various purposes, and they are also preferably used in combination.

In the present invention, organic metal salts can also be used as oxidizing agents in combination with the light-sensitive silver halide emulsions. Of these organic metal salts, organic silver salts are particularly preferably used.

Organic compounds which can be used for formation of the above-mentioned organic silver salt oxidizing agents include benzotriazole compounds, fatty acids and other compounds described in U.S. Pat. No. 4,500,626, column 52 and 53. Silver acetylide described in U.S. Pat. No. 4,775,613 is also useful. The organic silver salts may be used in combination.

The organic silver salts described above can be used in an amount of 0.01 to 10 mol, preferably 0.01 to 1 mol, per mol of light-sensitive silver halide.

The total coated amount of the light-sensitive silver halide emulsions and the organic silver salts is suitably 0.05 to 10 $g/m^2$ in terms of silver, and preferably 0.1 to 4 $g/m^2$.

In the heat development photographic materials of the present invention, compounds for activating development and stabilizing images can be used. Examples of the compounds preferably used are described in U.S. Pat. No. 4,500,626, column 51 and 52. Further, compounds which can fix silver halides as described in Japanese Patent Application No. 6-206331 can also be used.

The hardeners used in the layers constituting the heat development photographic materials include hardeners described in Research Disclosures stated above, U.S. Pat. Nos. 4,678,739, column 41, and 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinyl sulfone hardeners (such as N,N'-ethylene-bis(vinylsulfonyl-acetamido)ethane), N-methylol hardeners (dimethylolurea) and polymer hardeners (compounds described in JP-A-62-234157).

These hardeners are used in an amount of 0.001 to 1 g, preferably 0.005 to 0.5 g, per g of gelatin coated. They may be added to any of the layers constituting the photographic materials or dye fixing materials, and may be divided to add them to at least two layers.

In the layers constituting the heat development photographic materials, various antifoggants or photographic stabilizers and precursors thereof can be used. Examples thereof include compounds described in Research Disclosures stated above, U.S. Pat. Nos. 5,089,378, 4,500,627 and 4,614,702, JP-A-64-13546, pages 7–9, 57–71 and 81–97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650 and RD, 17648 (1978), pages 24 and 25.

These compounds are preferably used in an amount of $5\times10^{-6}$ to $1\times10^{-1}$ mol, more preferably $1\times10^{-5}$ to $1\times10^{-2}$ mol, per mol of silver.

In the layers constituting the heat development photographic materials, various surfactants can be used for the purposes of assisting coating, improving separation, improving sliding property, preventing electric charge, and accelerating development. Examples of the surfactants are described in Research Disclosures stated above, JP-A-62-173463 and JP-A-62-183457.

The layers constituting the heat development photographic materials may contain organic fluoro compounds for the purposes of improving sliding property, preventing electric charge and improving separation. Typical examples of the organic fluoro compounds include fluorine surfactants described in JP-B-57-9053, columns 8 to 17, JP-A-61-20944 and JP-A-62-135826, and hydrophobic fluorine compounds such as oily fluorine compounds (for example, fluorine oil) and solid fluorine compounds (for example, ethylene tetrafluoride resins).

The heat development photographic materials can contain matte agents for the purposes of preventing adhesion, improving sliding property and delustering surfaces of the photographic materials. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in Research Disclosures stated above can be used. These matte agents can be added not only to the uppermost layers (protective layers), but also to lower layers as needed.

Besides, the heat development photographic materials may contain heat solvents, defoaming agents, microbicidal antifungal agents and colloidal silica. Examples of these additives are described in JP-A-61-88256, pages 26 to 32, JP-A-3-11338 and JP-B-2-51496.

In the present invention, image formation accelerating agents can be used in the heat development photographic materials. The image formation accelerating agents have the functions of accelerating oxidation-reduction reaction of silver salt oxidizing agents with reducing agents, and accelerating reaction such as formation or decomposition of dyes derived from dye donating substances, or release of diffusible dyes, and can be classified into bases or base precursors, nucleophilic compounds, high boiling organic solvents (oils), heat solvents, surfactants, compounds having interaction with silver or silver ions, etc. according to the physicochemical functions. However, a group of these substances generally has combined functions, and therefore, it usually has a combination of some of the above-mentioned accelerating effects. The details thereof are described in U.S. Pat. No. 4,678,739, columns 38 to 40.

The base precursors include organic acids and base salts which can be decarboxylated by heat, and compounds releasing amines by intramolecular nucleophilic displacement reaction, the Lossen rearrangement or the Beckmann rearrangement. Examples thereof are described in U.S. Pat. Nos. 4,514,493 and 4,657,848.

In the present invention, various development stoppers can be used in the heat development photographic materials for the purpose of obtaining always constant images against fluctuations in processing temperature and processing time on development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors releasing acids by heating, electrophilic compounds which conduct replacement reaction with coexisting bases by heating, nitrogen-containing heterocyclic compounds, mercapto compounds and precursors thereof. More specifically, they are described in JP-A-62-253159, pages 31 and 32.

Methods for exposing the heat development photographic materials to record images include, for example, methods of directly taking landscape photographs or human subject photographs by use of cameras, methods of exposing the photographic materials through reversal films or negative films by use of printers or enlargers, methods of subjecting original pictures to scanning exposure through slits by use of exposing devices of copying machines, methods of allowing light emitting diodes or various lasers (such as laser diodes and gas lasers) to emit light by image information through electric signals to subject the photographic materials to scanning exposure (methods described in JP-A-2-129625, JP-A-5-176144, JP-A-5-199372 and JP-A-6-127021), and methods of supplying image information to image displays such as CRTs, liquid crystal displays, electroluminescence displays and plasma displays to expose the photographic materials directly or through optical systems.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record images on the heat development photographic materials.

Further, images can also be exposed using wavelength converting elements in which non-linear optical materials and coherent light sources such as laser beams. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432.

As the forms of the wavelength conversion elements, the single crystal light guide type and the fiber type are known, and both are useful.

Further, as the above-mentioned image information, there can be utilized image signals obtained from video cameras, electronic still cameras, etc., television signals represented by the Nippon Television Signal Criteria (NTSC), image signals obtained by dividing original pictures into many picture elements with scanners and image signals produced by use of computers represented by CGs and CADs.

The heat development photographic material of the present invention may have a conductive exothermic layer as a heating means for heat development. In this case, an exothermic element described in JP-A-61-145544 can be utilized.

The heating temperature in the heat development stage is about 80° C. to about 180° C., and the heating time is 0.1 seconds to 60 seconds.

Heating methods in the development stage include methods of bringing the photographic materials into contact with heated blocks, heated plates, hot pressers, heated rolls, heated drums, halogen lamp heaters, infrared or far infrared lamp heaters, etc., and methods of passing the photographic materials through an atmosphere of high temperature.

To overlapping of the heat development photographic materials and the dye fixing materials, methods described in JP-A-62-253159 and JP-A-61-147244, page 27 can be applied.

The present invention will be further illustrated in greater detail with reference to the following examples, which are, however, not to be construed as limiting the invention.

EXAMPLE 1

<Methods for Preparing Light-Sensitive Silver Halide Emulsions>

Light-Sensitive Silver Halide Emulsion (1) [for Red-Sensitive Emulsion Layer]

Solution (1) and solution (2) shown in Table 1 were concurrently added to a well-stirred aqueous solution of gelatin (a solution of 16 g of gelatin, 0.24 g of potassium bromide, 1.6 g of sodium chloride and 24 mg of compound (a) in 540 ml of water heated at 55° C.) at the same flow rate for 19 minutes. After 5 minutes, solution (3) and solution (4) shown in Table 1 were further concurrently added thereto at the same flow rate for 24 minutes. After washing and salt removal by a conventional method, 17.6 g of lime-treated ossein gelatin and 56 mg of compound (b) were added to adjust the pH and the pAg to 6.2 and 7.7, respectively. Then, 0.41 g of a decomposed product of ribonucleic acid and 1.02 mg of trimethylthiourea were added, followed by optimum chemical sensitization at 60° C. Thereafter, 0.18 g of 4-hydroxy-6-methyl-1,3,3a,7-tetraazainedene, 64 mg of sensitizing dye (c) and 0.41 g of potassium bromide were in turn added, followed by cooling. Thus, 590 g of a monodisperse cubic silver chlorobromide emulsion having a mean grain size of 0.30 μm was obtained.

TABLE 1

| | Solution (1) | Solution (2) | Solution (3) | Solution (4) |
|---|---|---|---|---|
| $AgNO_3$ | 24.0 g | — | 56.0 g | — |
| $NH_4NO_3$ | 50.0 mg | — | 50.0 mg | — |
| KBr | — | 10.9 g | — | 35.3 g |
| NaCl | — | 2.88 g | — | 1.92 g |
| $K_2IrCl_6$ | — | 0.07 mg | — | — |
| Amount Completed | Water to make 130 ml | Water to make 200 ml | Water to make 130 ml | Water to make 200 ml |

Compound (a)

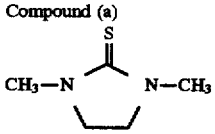

Compound (b)

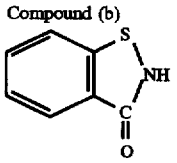

TABLE 1-continued

| | Solution (1) | Solution (2) | Solution (3) | Solution (4) |
|---|---|---|---|---|

Dye (C)

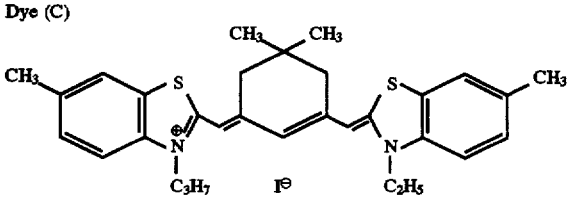

Light-Sensitive Silver Halide Emulsion (2) [for Green-Sensitive Emulsion Layer]

Solution (1) and solution (2) shown in Table 2 were concurrently added to a well-stirred aqueous solution of 5 gelatin (a solution of 20 g of gelatin, 0.30 g of potassium bromide, 2.0 g of sodium chloride and 30 mg of compound (a) in 600 ml of water heated at 46° C.) at the same flow rate for 10 minutes. After 5 minutes, solution (3) and solution (4) shown in Table 2 were further concurrently added thereto at the same flow rate for 30 minutes. One minute after termination of addition of solutions (3) and (4), 600 ml of a solution of sensitizing dyes in methanol (containing 360 mg of sensitizing dye ($d_1$) and 73.4 mg of sensitizing dye ($d_2$)) was added. After washing and salt removal (conducted using sedimenting agent (e) at pH 4.0) by a conventional method, 22 g of lime-treated ossein gelatin was added to adjust the pH and the pAg to 6.0 and 7.6, respectively. Then, 1.8 mg of sodium thiosulfate and 180 mg of 4-hydroxy-6-methyl-1,3,3a,7-tetraazainedene were added, followed by optimum chemical sensitization at 60° C. Thereafter, 90 mg of antifoggant (f), and 70 mg of compound (b) and 3 ml of compound (g) as preservatives were added, followed by cooling. Thus, 635 g of a monodisperse cubic silver chlorobromide emulsion having a mean grain size of 0.30 μm was obtained.

TABLE 2

| | Solution (1) | Solution (2) | Solution (3) | Solution (4) |
|---|---|---|---|---|
| $AgNO_3$ | 10.0 g | — | 90.0 g | — |
| $NH_4NO_3$ | 60.0 mg | — | 380 mg | — |
| KBr | — | 3.50 g | — | 57.1 g |
| NaCl | — | 1.72 g | — | 3.13 g |
| $K_2IrCl_6$ | — | — | — | 0.03 mg |
| Amount Completed | Water to make 126 ml | Water to make 131 ml | Water to make 280 ml | Water to make 289 ml |

TABLE 2-continued

| | Solution (1) | Solution (2) | Solution (3) | Solution (4) |
|---|---|---|---|---|

Dye ($d_1$)

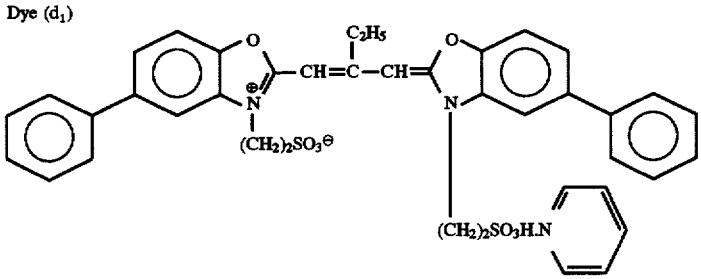

Dye ($d_2$)

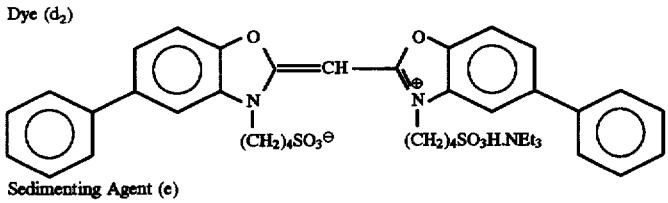

Sedimenting Agent (e)

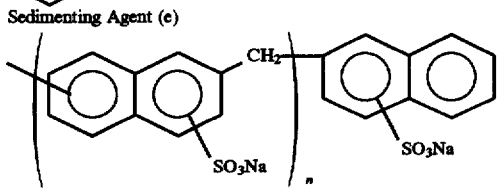

Antifoggant (f)

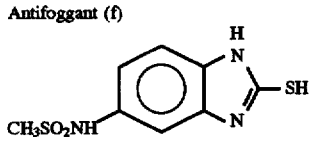

Compound (g)

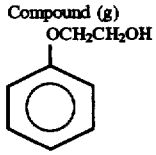

Light-Sensitive Silver Halide Emulsion (3) [for Blue-Sensitive Emulsion Layer]

First, addition of solution (2) shown in Table 3 to a well-stirred aqueous solution of gelatin (a solution of 31.6 g of gelatin, 2.5 g of potassium bromide and 13 mg of compound (a) in 584 ml of water heated at 70° C.) was started. After 10 minutes, addition of solution (1) was started. Solutions (1) and (2) were thereafter added for 30 minutes. Five minutes after termination of addition of solution (2), addition of solution (4) shown in Table 3 was further started, and after 10 seconds, addition of solution (3) was started. Solution (3) was added for 27 minutes and 50 seconds, and solution (4) was added for 28 minutes. After washing and salt removal (conducted using sedimenting agent (e') at pH 3.9) by a conventional method, 24.6 g of lime-treated ossein gelatin and 56 mg of compound (b) were added to adjust the pH and the pAg to 6.1 and 8.5, respectively. Then, 0.55 mg of sodium thiosulfate was added, followed by optimum chemical sensitization at 65° C. Thereafter, 0.35 g of sensitizing dye (h), 56 mg of antifoggant (i) and 2.3 ml of compound (g) as a preservative were added, followed by cooling. Thus, 582 g of a monodisperse octahedral silver bromide emulsion having a mean grain size of 0.55 μm was obtained.

TABLE 3

| | Solution (1) | Solution (2) | Solution (3) | Solution (4) |
|---|---|---|---|---|
| $AgNO_3$ | 15.8 g | — | 72.2 g | — |
| $NH_4NO_3$ | 68.0 mg | — | 308 mg | — |
| KBr | — | 11.4 g | — | 52.2 g |
| Amount Completed | Water to make 134 ml | Water to make 134 ml | Water to make 194 ml | Water to make 195 ml |

Sedimenting Agent (e')

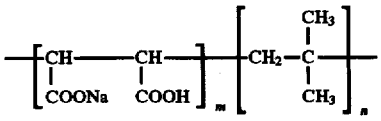

m + n = 1

TABLE 3-continued

| | Solution (1) | Solution (2) | Solution (3) | Solution (4) |
|---|---|---|---|---|

Dye (h)

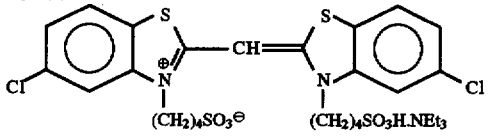

Antifoggant (i)

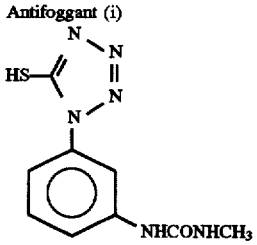

Benzotriazole Silver Emulsion [Organic Silver Salt]

In 300 ml of water, 28 g of gelatin and 13.2 g of benzotriazole were dissolved. The resulting solution was maintained at 40° C. and stirred. A solution of 17 g of silver nitrate in 100 ml of water was added to this solution for 2 minutes. The pH of the resulting benzotriazole silver emulsion was adjusted to remove excess salts by sedimentation. Then, the pH was adjusted to 6.30 to obtain 400 g of a benzotriazole silver emulsion.

<Method for Preparing Emulsified Dispersions of Couplers>

The oil phase ingredients and aqueous phase ingredients shown in Table 4 were each dissolved to form homogeneous solutions having a temperature of 60° C. Both the solutions were combined and dispersed in a 1-liter stainless steel vessel with a dissolver equipped with a 5-cm diameter disperser at 10,000 rpm for 20 minutes. Then, hot water was added in amounts shown in Table 4 as post water addition, followed by mixing at 2,000 rpm for 10 minutes. Thus, emulsified dispersions of three colors of cyan, magenta and yellow were prepared.

TABLE 4

| | | Cyan | Magenta | Yellow |
|---|---|---|---|---|
| Oil Phase | Cyan Coupler (1) | 4.64 g | — | — |
| | Magenta Coupler (2) | — | 3.18 g | — |
| | Yellow Coupler (3) | — | — | 2.96 g |
| | Developing Agent (4) | 1.78 g | 1.78 g | 1.78 g |
| | Antifoggant (5) | 0.08 g | 0.08 g | 0.08 g |
| | High Boiling Solvent (6) | 4.08 g | 4.85 g | 3.83 g |
| | Ethyl Acetate | 24 ml | 24 ml | 24 ml |
| Aqueous | Lime-Treated Gelatin | 5.0 g | 5.0 g | 5.0 g |
| | Surfactant (7) | 0.40 g | 0.40 g | 0.40 g |

TABLE 4-continued

| | | Cyan | Magenta | Yellow |
|---|---|---|---|---|
| Phase | Water | 75.0 ml | 75.0 ml | 75.0 ml |
| | Post Water Addition | 60.0 ml | 60.0 ml | 60.0 ml |

Cyan Coupler (1)

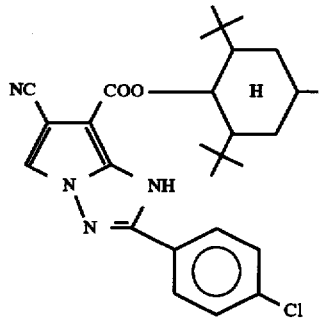

Magenta Coupler (2)

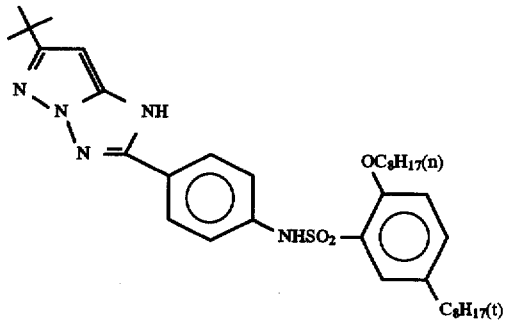

Yellow Coupler (3)

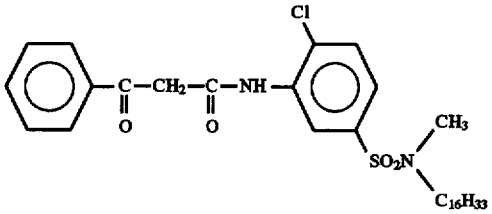

Developing Agent (4)

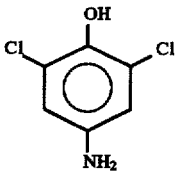

Antifoggant (5)

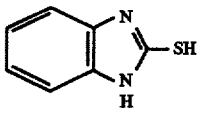

High Boiling Solvent (6)

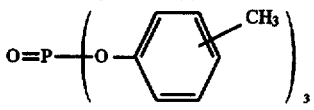

TABLE 4-continued

| | Cyan | Magenta | Yellow |
|---|---|---|---|

Surfactant (7)

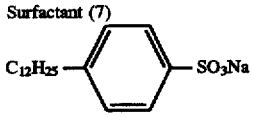

Using the materials thus obtained, heat development color photographic material 101 having the multilayer constitution shown in Table 5 was prepared.

TABLE 5

| Layer Constitution | Material Added | Amount Added ($mg/m^2$) |
|---|---|---|
| 6th Layer Protective Layer | Lime-Treated Gelatin | 1940 |
| | Matte Agent (Silica) | 200 |
| | Surfactant (8) | 50 |
| | Surfactant (9) | 300 |
| | Base Precursor (10) | 1400 |
| | Water-Soluble Polymer (11) | 120 |
| 5th Layer Yellow Color Formation Layer | Lime-Treated Gelatin | 2000 |
| | Blue-Sensitive Silver Halide Emulsion | 1250 (converted to silver) |
| | Benzotriazole Silver Emulsion | 300 (converted to silver) |
| | Yellow Coupler (3) | 600 |
| | Developing Agent (4) | 360 |
| | Antifoggant (5) | 16 |
| | High Boiling Solvent (6) | 774 |
| | Surfactant (7) | 80 |
| | Heat Solvent (12) | 1400 |
| | Surfactant (9) | 70 |
| | Water-Soluble Polymer (11) | 40 |
| 4th Layer Intermediate Layer | Lime-Treated Gelatin | 970 |
| | Surfactant (8) | 50 |
| | Surfactant (9) | 300 |
| | Base Precursor (10) | 1400 |
| | Water-Soluble Polymer (11) | 60 |
| 3rd Layer Magenta Color Formation Layer | Lime-Treated Gelatin | 1000 |
| | Green-Sensitive Silver Halide Emulsion | 625 (converted to silver) |
| | Benzotriazole Silver Emulsion | 150 (converted to silver) |
| | Magenta Coupler (2) | 320 |
| | Developing Agent (4) | 180 |
| | Antifoggant (5) | 8 |
| | High Boiling Solvent (6) | 490 |
| | Surfactant (7) | 40 |
| | Heat Solvent (12) | 700 |
| | Surfactant (9) | 35 |
| | Water-Soluble Polymer (11) | 20 |
| 2nd Layer Intermediate Layer | Lime-Treated Gelatin | 970 |
| | Surfactant (8) | 50 |
| | Surfactant (9) | 300 |
| | Base Precursor (10) | 1400 |
| | Water-Soluble Polymer (11) | 60 |
| 1st Layer Cyan Color Formation Layer | Lime-Treated Gelatin | 1000 |
| | Red-Sensitive Silver Halide Emulsion | 625 (converted to silver) |
| | Benzotriazole Silver Emulsion | 150 (converted to silver) |
| | Cyan Coupler (1) | 470 |
| | Developing Agent (4) | 180 |
| | Antifoggant (5) | 8 |
| | High Boiling Solvent (6) | 410 |
| | Surfactant (7) | 40 |

TABLE 5-continued

| Layer Constitution | Material Added | Amount Added ($mg/m^2$) |
|---|---|---|
| | Heat Solvent (12) | 700 |
| | Surfactant (9) | 35 |
| | Water-Soluble Polymer (11) | 20 |

Transparent PET Base (102 μm)

Surfactant (8)

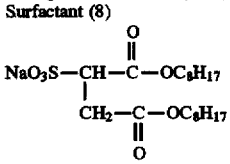

Surfactant (9)

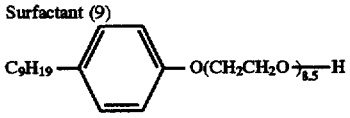

Base Precursor (10)

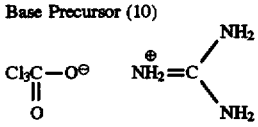

Water-Soluble Polymer (11)

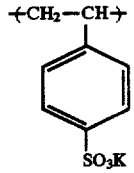

Heat Solvent (12)

D-Sorbitol

Then, photographic materials 102 to 120 were prepared which have the same composition as photographic material 101 with the exception that the developing agent was replaced as shown in Table 6. For each of photographic materials 101 to thus obtained, two samples were prepared, one of which was just after coating, and the other of which was stored at 45° C. at 80% RH for 3 days after coating. These 40 samples were exposed at 2000 lux for 1 second through blue, green and red filters continuously changed in density. The exposed samples were brought into contact with a heat drum heated at 140° C. on their base side to conduct heat development for 10 seconds. Upon departure from the drum after processing, color images of cyan, magenta and yellow were clearly obtained corresponding to the filters through which the samples were exposed. Immediately after processing, the maximum density (Dmax) and the minimum density (Dmin) were measured for each sample with an X-rite densitometer. Results are shown in Tables 7 and 8.

TABLE 6

| | Cyan | | Magenta | | Yellow | |
|---|---|---|---|---|---|---|
| Sample Name | Developing Agent | Amount Added | Developing Agent | Amount Added | Developing Agent | Amount Added |
| 101 (Comparison) | (4) | 1.0 | (4) | 1.0 | (4) | 1.0 |
| 102 | 1 | 1.0 | 1 | 1.0 | 1 | 1.0 |

TABLE 6-continued

| Sample Name | Cyan Developing Agent | Cyan Amount Added | Magenta Developing Agent | Magenta Amount Added | Yellow Developing Agent | Yellow Amount Added |
|---|---|---|---|---|---|---|
| (Comparison) 103 | 2 | 1.0 | 2 | 1.0 | 2 | 1.0 |
| (Comparison) 104 | 3 | 1.0 | 3 | 1.0 | 3 | 1.0 |
| (Comparison) 105 | 4 | 1.0 | 4 | 1.0 | 4 | 1.0 |
| (Comparison) 106 | 5 | 1.0 | 5 | 1.0 | 5 | 1.0 |
| (Comparison) 107 | 5 | 1.5 | 5 | 1.5 | 5 | 1.5 |
| (Comparison) 108 | 6 | 1.0 | 6 | 1.0 | 6 | 1.0 |
| (Comparison) 109 | 6 | 2.0 | 6 | 2.0 | 6 | 2.0 |
| (Comparison) 110 | 7 | 1.0 | 7 | 1.0 | 7 | 1.0 |
| (Comparison) 111 | 7 | 2.0 | 7 | 2.0 | 7 | 2.0 |
| (Comparison) 112 | 8 | 1.0 | 8 | 1.0 | 8 | 1.0 |
| (Comparison) 113 | 8 | 2.0 | 8 | 2.0 | 8 | 2.0 |
| (Comparison) 114 | D-1 | 1.0 | D-1 | 1.0 | D-1 | 1.0 |
| (Invention) 115 | D-6 | 1.0 | D-6 | 1.0 | D-6 | 1.0 |
| (Invention) 116 | D-8 | 1.0 | D-8 | 1.0 | D-8 | 1.0 |
| (Invention) 117 | D-11 | 1.0 | D-11 | 1.0 | D-11 | 1.0 |
| (Invention) 118 | D-16 | 1.0 | D-16 | 1.0 | D-16 | 1.0 |
| (Invention) 119 | D-20 | 1.0 | D-20 | 1.0 | D-20 | 1.0 |
| (Invention) 120 | D-21 | 1.0 | D-21 | 1.0 | D-21 | 1.0 |
| (Invention) | | | | | | |

The amount added is represented by the molar ratio to the developing agent of each layer of photographic material 101.

Developing Agent 1

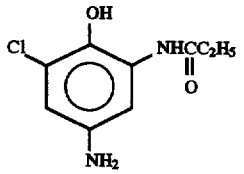

-continued

Developing Agent 2

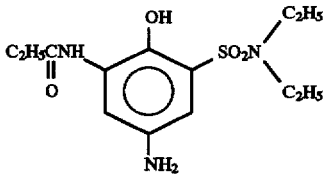

Developing Agent 3

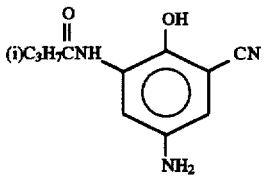

Developing Agent 4

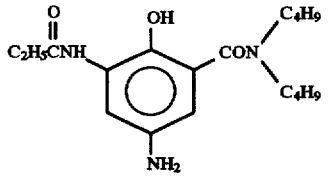

Developing Agent 5

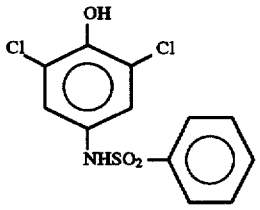

Developing Agent 6

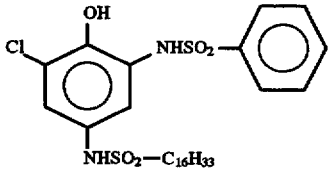

Developing Agent 7

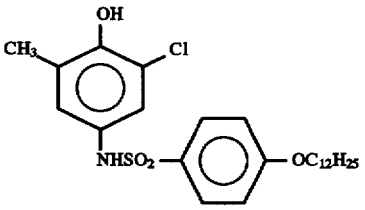

Developing Agent 8

-continued

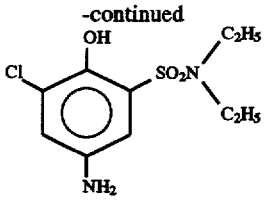

TABLE 7

| | Before Storage | | | | | |
|---|---|---|---|---|---|---|
| | Cyan | | Magenta | | Yellow | |
| Sample Name | Dmax | Dmin | Dmax | Dmin | Dmax | Dmin |
| 101 (Comparison) | 1.22 | 0.20 | 1.18 | 0.21 | 0.95 | 0.21 |
| 102 (Comparison) | 1.21 | 0.20 | 1.20 | 0.21 | 0.94 | 0.21 |
| 103 (Comparison) | 1.23 | 0.20 | 1.20 | 0.21 | 0.96 | 0.21 |
| 104 (Comparison) | 1.21 | 0.20 | 1:19 | 0.21 | 0.95 | 0.21 |
| 105 (Comparison) | 1.21 | 0.20 | 1.20 | 0.21 | 0.95 | 0.21 |
| 106 (Comparison) | 0.61 | 0.20 | 0.55 | 0.21 | 0.46 | 0.21 |
| 107 (Comparison) | 0.71 | 0.23 | 0.62 | 0.24 | 0.51 | 0.21 |
| 108 (Comparison) | 0.63 | 0.20 | 0.54 | 0.21 | 0.48 | 0.21 |
| 109 (Comparison) | 0.72 | 0.22 | 0.62 | 0.23 | 0.53 | 0.21 |
| 110 (Comparison) | 0.60 | 0.20 | 0.54 | 0.21 | 0.48 | 0.21 |
| 111 (Comparison) | 0.70 | 0.23 | 0.63 | 0.24 | 0.53 | 0.21 |
| 112 (Comparison) | 0.61 | 0.20 | 0.55 | 0.21 | 0.47 | 0.21 |
| 113 (Comparison) | 0.71 | 0.22 | 0.62 | 0.23 | 0.54 | 0.21 |
| 114 (Invention) | 1.22 | 0.20 | 1.19 | 0.21 | 0.95 | 0.21 |
| 115 (Invention) | 1.23 | 0.20 | 1.21 | 0.21 | 0.96 | 0.21 |
| 116 (Invention) | 1.22 | 0.20 | 1.20 | 0.21 | 0.95 | 0.21 |
| 117 (Invention) | 1.22 | 0.20 | 1.20 | 0.21 | 0.96 | 0.21 |
| 118 (Invention) | 1.21 | 0.20 | 1.21 | 0.21 | 0.96 | 0.21 |
| 119 (Invention) | 1.22 | 0.20 | 1.19 | 0.21 | 0.95 | 0.21 |
| 120 (Invention) | 1.21 | 0.21 | 1.20 | 0.21 | 0.95 | 0.21 |

TABLE 8

| | After Storage | | | | | |
|---|---|---|---|---|---|---|
| | Cyan | | Magenta | | Yellow | |
| Sample Name | Dmax | Dmin | Dmax | Dmin | Dmax | Dmin |
| 101 (Comparison) | 1.21 | 1.17 | 1.19 | 1.15 | 0.96 | 0.92 |
| 102 (Comparison) | 1.22 | 1.15 | 1.21 | 1.16 | 0.94 | 0.92 |
| 103 (Comparison) | 1.23 | 1.16 | 1.21 | 1.14 | 0.95 | 0.93 |
| 104 (Comparison) | 1.21 | 1.14 | 1.19 | 1.17 | 0.96 | 0.94 |
| 105 (Comparison) | 1.21 | 1.16 | 1.19 | 1.15 | 0.95 | 0.92 |
| 106 (Comparison) | 0.62 | 0.34 | 0.56 | 0.32 | 0.47 | 0.29 |
| 107 (Comparison) | 0.71 | 0.45 | 0.63 | 0.40 | 0.51 | 0.35 |
| 108 (Comparison) | 0.63 | 0.34 | 0.54 | 0.32 | 0.49 | 0.28 |
| 109 (Comparison) | 0.72 | 0.46 | 0.62 | 0.41 | 0.52 | 0.36 |
| 110 (Comparison) | 0.62 | 0.34 | 0.53 | 0.33 | 0.48 | 0.28 |
| 111 (Comparison) | 0.71 | 0.47 | 0.63 | 0.41 | 0.54 | 0.35 |
| 112 (Comparison) | 0.62 | 0.35 | 0.55 | 0.32 | 0.47 | 0.29 |
| 113 (Comparison) | 0.72 | 0.46 | 0.64 | 0.45 | 0.55 | 0.34 |
| 114 (Invention) | 1.22 | 0.34 | 1.19 | 0.32 | 0.96 | 0.29 |
| 115 (Invention) | 1.23 | 0.35 | 1.22 | 0.33 | 0.97 | 0.29 |
| 116 (Invention) | 1.23 | 0.34 | 1.21 | 0.32 | 0.95 | 0.29 |
| 117 (Invention) | 1.22 | 0.34 | 1.20 | 0.33 | 0.96 | 0.28 |
| 118 (Invention) | 1.22 | 0.34 | 1.22 | 0.32 | 0.97 | 0.29 |
| 119 (Invention) | 1.23 | 0.34 | 1.21 | 0.33 | 0.95 | 0.29 |
| 120 (Invention) | 1.21 | 0.34 | 1.19 | 0.33 | 0.96 | 0.28 |

Summing up the results of Tables 7 and 8, photographic materials 102 to 105 using p-aminophenol provide images high in activity and excellent in discrimination, but have the disadvantage of increasing in Dmin for the photographic materials after storage, resulting in poor raw preservability.

Photographic materials 106 to 113 using p-sulfonamidophenol which are different from the compounds of the present invention in structure are improved in raw preservability, but low in Dmax.

In contrast to these photographic materials for comparison, photographic materials 114 to 120 using the developing agents of the present invention are excellent in both discrimination and raw preservability of images. From the above, the effects of the present invention is apparent.

EXAMPLE 2

<Method for Preparing Zinc Hydroxide Dispersion>

Thirty-one grams of zinc oxide powder in which primary grains have a grain size of 0.2 μm, 1.6 g of carboxymethyl cellulose as a dispersing agent, 0.4 g of poly(sodium acrylate), 8.5 g of lime-treated ossein gelatin and 158.5 ml of water were mixed, and the resulting mixture was dispersed in a mill using glass beads for 1 hour. After dispersion, the glass beads were filtered off to obtain 188 g of zinc hydroxide dispersion.

Using zinc hydroxide dispersion thus obtained, heat development color photographic material 201 shown in Table 9 was prepared.

TABLE 9

| Layer Constitution | Material Added | Amount Added ($mg/m^2$) |
|---|---|---|
| 6th Layer Protective Layer | Lime-Treated Gelatin | 1940 |
| | Matte Agent (Silica) | 200 |
| | Surfactant (8) | 50 |
| | Surfactant (9) | 300 |
| | Zinc Hydroxide | 600 |
| | Water-Soluble Polymer (11) | 120 |
| 5th Layer Yellow Color Formation Layer | Lime-Treated Gelatin | 2000 |
| | Blue-Sensitive Silver Halide Emulsion | 1250 (converted to silver) |
| | Yellow Coupler (3) | 600 |
| | Developing Agent (4) | 360 |
| | Antifoggant (5) | 16 |
| | High Boiling Solvent (6) | 774 |
| | Surfactant (7) | 80 |
| | Water-Soluble Polymer (11) | 40 |
| 4th Layer Intermediate Layer | Lime-Treated Gelatin | 970 |
| | Surfactant (8) | 50 |
| | Surfactant (9) | 300 |
| | Zinc Hydroxide | 400 |
| | Water-Soluble Polymer (11) | 60 |
| 3rd Layer Magenta Color Formation Layer | Lime-Treated Gelatin | 1000 |
| | Green-Sensitive Silver Halide Emulsion | 625 (converted to silver) |
| | Magenta Coupler (2) | 320 |
| | Developing Agent (4) | 180 |
| | Antifoggant (5) | 8 |
| | High Boiling Solvent (6) | 490 |
| | Surfactant (7) | 40 |
| | Water-Soluble Polymer (11) | 20 |
| 2nd Layer Intermediate Layer | Lime-Treated Gelatin | 970 |
| | Surfactant (8) | 50 |
| | Surfactant (9) | 300 |
| | Zinc Hydroxide | 400 |
| | Water-Soluble Polymer (11) | 60 |
| 1st Layer Cyan Color Formation Layer | Lime-Treated Gelatin | 1000 |
| | Red-Sensitive Silver Halide Emulsion | 625 (converted to silver) |
| | Cyan Coupler (1) | 470 |
| | Developing Agent (4) | 180 |
| | Antifoggant (5) | 8 |

TABLE 9-continued

| Layer Constitution | Material Added | Amount Added ($mg/m^2$) |
|---|---|---|
| | High Boiling Solvent (6) | 410 |
| | Surfactant (7) | 40 |
| | Water-Soluble Polymer (11) | 20 |

Transparent PET Base (102 μm)

Then, photographic materials 202 to 216 were prepared which have the same composition as photographic material 201 with the exception that the developing agent was replaced as shown in Table 10. For each of photographic materials 201 to thus obtained, two samples were prepared, one of which was just after coating, and the other of which was stored at 45° C. at 80% RH for 3 days after coating. A magazine of FUJIX PICTROSTAT 200 (manufactured by Fuji Photo Film Co. Ltd.) was loaded with these 32 samples, and a slide enlarging unit was equipped with blue, green and red filters continuously changed in density to conduct heat development under the standard conditions. When the image-received materials were separated after processing, color images of cyan, magenta and yellow were clearly obtained on the photographic material side, corresponding to the filters through which the samples were exposed. Immediately after processing, the maximum density (Dmax) and the minimum density (Dmin) were measured for each sample with an X-rite densitometer. Results are shown in Tables 11 and 12.

TABLE 10

| | Cyan | | Magenta | | Yellow | |
|---|---|---|---|---|---|---|
| Sample Name | Developing Agent | Amount Added | Developing Agent | Amount Added | Developing Agent | Amount Added |
| 201 (Comparison) | (4) | 1.0 | (4) | 1.0 | (4) | 1.0 |
| 202 (Comparison) | 1 | 1.0 | 1 | 1.0 | 1 | 1.0 |
| 203 (Comparison) | 2 | 1.0 | 2 | 1.0 | 2 | 1.0 |
| 204 (Comparison) | 4 | 1.0 | 4 | 1.0 | 4 | 1.0 |
| 205 (Comparison) | 5 | 1.0 | 5 | 1.0 | 5 | 1.0 |
| 206 (Comparison) | 5 | 1.5 | 5 | 1.5 | 5 | 1.5 |
| 207 (Comparison) | 6 | 1.0 | 6 | 1.0 | 6 | 1.0 |
| 208 (Comparison) | 6 | 2.0 | 6 | 2.0 | 6 | 2.0 |
| 209 (Comparison) | 7 | 1.0 | 7 | 1.0 | 7 | 1.0 |
| 210 (Comparison) | 7 | 2.0 | 7 | 2.0 | 7 | 2.0 |
| 211 (Invention) | D-1 | 1.0 | D-1 | 1.0 | D-1 | 1.0 |
| 212 (Invention) | D-8 | 1.0 | D-8 | 1.0 | D-8 | 1.0 |

TABLE 10-continued

| | Cyan | | Magenta | | Yellow | |
|---|---|---|---|---|---|---|
| Sample Name | Developing Agent | Amount Added | Developing Agent | Amount Added | Developing Agent | Amount Added |
| 213 (Invention) | D-10 | 1.0 | D-10 | 1.0 | D-10 | 1.0 |
| 214 (Invention) | D-11 | 1.0 | D-11 | 1.0 | D-11 | 1.0 |
| 215 (Invention) | D-19 | 1.0 | D-19 | 1.0 | D-19 | 1.0 |
| 216 (Invention) | D-22 | 1.0 | D-22 | 1.0 | D-22 | 1.0 |

The amount added is represented by the molar ratio to the developing agent of each layer of photographic material 201.

TABLE 11

| | Before Storage | | | | | |
|---|---|---|---|---|---|---|
| | Cyan | | Magenta | | Yellow | |
| Sample Name | Dmax | Dmin | Dmax | Dmin | Dmax | Dmin |
| 201 (Comparison) | 1.30 | 0.20 | 1.25 | 0.21 | 1.05 | 0.21 |
| 202 (Comparison) | 1.31 | 0.21 | 1.25 | 0.20 | 1.04 | 0.20 |
| 203 (Comparison) | 1.32 | 0.20 | 1.24 | 0.20 | 1.05 | 0.20 |
| 204 (Comparison) | 1.30 | 0.21 | 1.24 | 0.20 | 1.05 | 0.20 |
| 205 (Comparison) | 0.65 | 0.21 | 0.68 | 0.20 | 0.55 | 0.21 |
| 206 (Comparison) | 0.75 | 0.25 | 0.76 | 0.24 | 0.59 | 0.26 |
| 207 (Comparison) | 0.66 | 0.21 | 0.67 | 0.21 | 0.56 | 0.21 |
| 208 (Comparison) | 0.75 | 0.25 | 0.77 | 0.24 | 0.60 | 0.25 |
| 209 (Comparison) | 0.67 | 0.21 | 0.68 | 0.21 | 0.55 | 0.21 |
| 210 (Comparison) | 0.77 | 0.26 | 0.77 | 0.24 | 0.61 | 0.26 |
| 211 (Invention) | 1.31 | 0.21 | 1.25 | 0.21 | 1.05 | 0.21 |
| 212 (Invention) | 1.32 | 0.21 | 1.24 | 0.21 | 1.06 | 0.20 |
| 213 (Invention) | 1.32 | 0.21 | 1.26 | 0.21 | 1.04 | 0.21 |
| 214 (Invention) | 1.31 | 0.21 | 1.26 | 0.21 | 1.05 | 0.21 |
| 215 (Invention) | 1.33 | 0.21 | 1.25 | 0.21 | 1.06 | 0.21 |
| 216 (Invention) | 1.32 | 0.21 | 1.26 | 0.21 | 1.05 | 0.21 |

TABLE 12

| | After Storage | | | | | |
|---|---|---|---|---|---|---|
| | Cyan | | Magenta | | Yellow | |
| Sample Name | Dmax | Dmin | Dmax | Dmin | Dmax | Dmin |
| 201 (Comparison) | 1.30 | 1.02 | 1.24 | 1.00 | 1.07 | 0.80 |
| 202 (Comparison) | 1.32 | 1.05 | 1.25 | 1.02 | 1.05 | 0.79 |
| 203 (Comparison) | 1.31 | 1.04 | 1.25 | 1.00 | 1.06 | 0.81 |
| 204 (Comparison) | 1.31 | 1.08 | 1.24 | 1.01 | 1.05 | 0.82 |
| 205 (Comparison) | 0.66 | 0.30 | 0.69 | 0.31 | 0.56 | 0.28 |
| 206 (Comparison) | 0.75 | 0.36 | 0.77 | 0.37 | 0.60 | 0.35 |
| 207 (Comparison) | 0.66 | 0.31 | 0.66 | 0.31 | 0.55 | 0.27 |
| 208 (Comparison) | 0.74 | 0.37 | 0.78 | 0.38 | 0.60 | 0.35 |
| 209 (Comparison) | 0.68 | 0.31 | 0.67 | 0.30 | 0.56 | 0.29 |
| 210 (Comparison) | 0.76 | 0.38 | 0.76 | 0.36 | 0.62 | 0.35 |
| 211 (Invention) | 1.31 | 0.29 | 1.26 | 0.30 | 1.06 | 0.27 |
| 212 (Invention) | 1.31 | 0.29 | 1.25 | 0.30 | 1.04 | 0.27 |
| 213 (Invention) | 1.32 | 0.29 | 1.24 | 0.30 | 1.04 | 0.27 |
| 214 (Invention) | 1.33 | 0.29 | 1.25 | 0.30 | 1.04 | 0.27 |
| 215 (Invention) | 1.32 | 0.29 | 1.25 | 0.30 | 1.07 | 0.27 |
| 216 (Invention) | 1.32 | 0.29 | 1.26 | 0.30 | 1.05 | 0.27 |

Summing up the results of Tables 11 and 12, photographic materials 202 to 205 using p-aminophenol provide images high in activity and excellent in discrimination, but have the disadvantage of increasing in Dmin for the photographic materials after storage, resulting in poor raw preservability.

Photographic materials 206 to 210 using p-sulfonamidophenol which are different from the compounds of the present invention in structure are improved in raw preservability, but significantly reduced in Dmax.

In contrast to these photographic materials for comparison, photographic materials 211 to 216 using the developing agents of the present invention are excellent in both discrimination and raw preservability of images. Also in this Example, the effects of the present invention are apparent.

According to the present invention, heat development color photographic materials excellent in discrimination and raw preservability of images are obtained.

While the invention has been described in detail and with reference to specific embodiment thereof, it will be apparent to one skilled in the art that various changes and modifications can be made therein without departing from the spirit and scope thereof.

What is claimed is:

1. A heat development color photographic material comprising a support, a light-sensitive silver halide, a binder, a reducing agent and a coupler formed thereon, in which at least one compound represented by the following formula (I) is contained as said reducing agent:

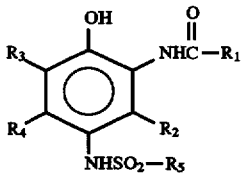

(I)

wherein $R_1$ represents an alkyl group, an alkenyl group, an alkynyl group, an aryl group, an alkylcarbonyl group, an arylcarbonyl group, an alkoxyl group, an aryloxygroup, an alkoxycarbonyl group, an aryloxycarbonyl group, an alkylamino group, an arylamino group or a heterocyclic group; $R_2$ and $R_4$ each independently represents a hydrogen atom, a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_3$ is a hydrogen atom, a halogen atom, an alkyl group, an aryl group, an alkylcarbonamido group, an arylcarbonamido group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group or an acyloxy group; and $R_5$ represents an alkyl group, an aryl group or a heterocyclic group.

2. A heat development color photographic material as in claim 1, wherein the compound represented by formula (I) has a molar ratio to the coupler of 0.01:1 to 100:1.

3. A heat development color photographic material as in claim 1, wherein the compound represented by formula (I) has a molar ratio to the coupler of 0.1:1 to 10:1.

4. A heat development color photographic material as in claim 1, wherein the compound represented by formula (I) has a molar ratio to the coupler of 0.2:1 to 5:1.

5. A heat development color photographic material as in claim 1, further comprising an organic metal salt oxidizing agent.

6. A heat development color photographic material according to claim 1, wherein the Hammett constants of substituent groups at the 2-, 3-, 5- and 6-positions of a benzene ring total 0 or more.

* * * * *